US009413072B2

(12) United States Patent
Yamamoto et al.

(10) Patent No.: US 9,413,072 B2
(45) Date of Patent: Aug. 9, 2016

(54) METHOD FOR INSTALLING ANTENNA DEVICE, AND ANTENNA DEVICE

(71) Applicant: Mitsubishi Electric Corporation, Chiyoda-ku (JP)

(72) Inventors: Takeshi Yamamoto, Chiyoda-ku (JP); Atsushi Hashimoto, Chiyoda-ku (JP); Hiroyuki Takeuchi, Chiyoda-ku (JP); Junji Takaki, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 14/773,121

(22) PCT Filed: Feb. 13, 2014

(86) PCT No.: PCT/JP2014/053322

§ 371 (c)(1),
(2) Date: Sep. 4, 2015

(87) PCT Pub. No.: WO2014/136543

PCT Pub. Date: Sep. 12, 2014

(65) Prior Publication Data

US 2016/0006128 A1 Jan. 7, 2016

(30) Foreign Application Priority Data

Mar. 5, 2013 (JP) ..... 2013-043201

(51) Int. Cl.
*H01Q 9/16* (2006.01)
*H01Q 9/28* (2006.01)
(Continued)

(52) U.S. Cl.
CPC . *H01Q 9/28* (2013.01); *H01Q 1/12* (2013.01); *H01Q 1/36* (2013.01); *H01Q 9/16* (2013.01); *H01Q 9/30* (2013.01); *H01Q 9/34* (2013.01)

(58) Field of Classification Search
CPC ..... H01Q 9/30; H01Q 9/34; H01Q 9/28; H01Q 1/12; H01Q 1/36
See application file for complete search history.

(56) References Cited

U.S. PATENT DOCUMENTS 2,578,154 A 12/1951 Shanklin
6,034,649 A * 3/2000 Wilson ..... H01Q 1/246 343/795

(Continued)

FOREIGN PATENT DOCUMENTS

JP 3-3503 A 1/1991
JP 6-90108 A 3/1994

(Continued)

OTHER PUBLICATIONS

International Search Report Issued May 20, 2014 in PCT/JP14/053322 Filed Feb. 13, 2014.

*Primary Examiner* — Trinh Dinh
(74) *Attorney, Agent, or Firm* — Oblon, McClelland, Maier & Neustadt, L.L.P

(57) ABSTRACT

In a lower-side-columnar-conductor installing process, a first columnar sub-conductor (2), a second columnar sub-conductor (3), and a first main columnar conductor (1) are set up individually, and the first main columnar conductor (1) is disposed between the first columnar sub-conductor (2) and the second columnar sub-conductor (3). In a U-shaped-conductor fastening process, the upper-side end portion of the first columnar sub-conductor (2) is arranged facing one end of a U-shaped conductor (7) bent in a U-shape, the upper-side end portion of the second columnar sub-conductor (3) is arranged facing the other end of the U-shaped conductor (7), and the center portion of the U-shaped conductor (7) is fastened to the tip portion of a second main columnar conductor (4).

17 Claims, 18 Drawing Sheets

(51) Int. Cl.

| | |
|---|---|
| ***H01Q 1/12*** | (2006.01) |
| ***H01Q 9/30*** | (2006.01) |
| ***H01Q 9/34*** | (2006.01) |
| ***H01Q 1/36*** | (2006.01) |

(56) References Cited

U.S. PATENT DOCUMENTS

| | | | | |
|---|---|---|---|---|
| 7,230,578 | B2 * | 6/2007 | Ke | H01Q 5/371 343/790 |
| 2004/0113858 | A1 * | 6/2004 | Tsai | H01Q 1/42 343/793 |
| 2005/0212713 | A1 * | 9/2005 | Dai | H01Q 9/28 343/792 |
| 2010/0295746 | A1 * | 11/2010 | Chow | H01Q 9/30 343/793 |
| 2011/0122029 | A1 * | 5/2011 | Bonwit | H01Q 1/24 343/702 |
| 2013/0033409 | A1 | 2/2013 | Leelaratne | |

FOREIGN PATENT DOCUMENTS

| | | | |
|---|---|---|---|
| JP | 2003-188632 | A | 7/2003 |
| JP | 2007-68106 | A | 3/2007 |
| JP | 2007-158762 | A | 6/2007 |
| JP | 2013-38785 | A | 2/2013 |
| WO | 90/15452 | A1 | 12/1990 |

* cited by examiner

METHOD FOR INSTALLING ANTENNA DEVICE, AND ANTENNA DEVICE

TECHNICAL FIELD

The present disclosure relates to a method for installing an antenna device and an antenna device that can facilitate installation.

BACKGROUND ART

Some conventional antenna devices utilize a dipole antenna, (for example, as in Patent Literature 1). In addition to the self-supporting type antenna devices like the antenna device disclosed in Patent Literature 1, there are also antenna devices that support an antenna element by a guy wire, (for example, as in Patent Literature 2). The antenna device disclosed in Patent Literature 2 utilizes a monopole antenna.

In general, in order to construct a high-gain dipole antenna, an antenna length that is substantially equivalent to a half wavelength of the utilized radio wave is necessary. Conversely, in order to construct a monopole antenna, an antenna length that is substantially equivalent to a quarter wavelength is necessary. When the frequency of the utilized radio wave is low, the antenna becomes several meters long. Hence, the assembly (installation) of an antenna device and the installation of the parts are quite cumbersome. In addition, the securing of wind resistance and earthquake resistance for an extremely long antenna element, as disclosed in Patent Literature 2, requires the fastening of the antenna element to a base using support members such as a large number of guy wires.

In order to avoid increase in installation area required for an antenna device and increase of parts cost and device maintenance cost, a high-gain and compact antenna is desired that does not need a large number of support members. In general, scheme for bending an exciter part is known as a scheme for suppressing gain reduction and for downsizing a linear antenna (for example, see Patent Literature 3 and Patent Literature 4). According to this scheme, downsizing and the securing of the necessary electrical length of the exciter part to maintain the gain can be simultaneously accomplished.

CITATION LIST

Patent Literature

Patent Literature 1: Unexamined Japanese Patent Application Kokai Publication No. 2007-158762 (all figures)

Patent Literature 2: Unexamined Japanese Patent Application Kokai Publication No. 2003-188632 (FIG. 1 and FIG. 13)

Patent Literature 3: Unexamined Japanese Patent Application Kokai Publication No. H3-3503 (FIG. 1)

Patent Literature 4: Unexamined Japanese Patent Application Kokai Publication No. H6-90108 (FIG. 1)

SUMMARY OF INVENTION

Technical Problem

A large sized linear antenna device utilizing a low frequency band can be downsized by bending the exciter part of the liner antenna. However, the full length of the exciter must be ensured in order to suppress gain reduction. When, for example, the size in the vertical direction is reduced, the size in the horizontal direction is inevitable to be increased.

Accordingly, just bending of the exciter part does not reduce remarkably the scale of the antenna device and the weight thereof. Therefore, when the antenna main body is installed at an outdoor location, countermeasures are necessary for wind and the like.

Conversely, when thinning of the structure of the antenna main body and application of a multistage structure are adopted as countermeasures, further weight reduction and the arrangement of a larger number of support members are not possible. Therefore, strength and the rigidity against vibration caused by wind are difficult to secure.

The present disclosure is made to address the above-explained problems, and it is an objective of the present disclosure to provide a method for installing an antenna device and an antenna device that can suppress gain reduction, and that can facilitate installation and assembly.

Solution to Problem

A method for installing an antenna device according to the present disclosure, in a lower-side-columnar-conductor installing process, a first support body is set up, a second support body is set up, and a main columnar conductor is set up, the main columnar conductor being set up between the first support body and the second support body. In a U-shaped-conductor fastening process, the upper-end portion of the first support body is disposed to face the one end of a U-shaped conductor bent in a U-shape, the upper-end portion of the second support body is disposed to face the other end of the U-shaped conductor, and the center portion of the U-shaped conductor is fastened to the tip portion of the main columnar conductor.

Advantageous Effects of Invention

As explained above, the present disclosure relates to an antenna device that includes the first support body, the second support body arranged in parallel with the first support body, the main columnar conductor arranged between the first support body and the second support body, and the U-shaped conductor bent in the U-shape, and including the one end that faces the tip portion of the first support body, the other end that faces the tip portion of the second support body, and the center part that is fastened to the tip portion of the main columnar conductor, and to a method for installing the antenna device. According to the present disclosure, the following advantageous effects can be accomplished.

According to the present disclosure, a installing of an antenna device and the like can be obtained that suppresses the gain reduction, and that facilitates transport and assembling, because it is possible to install the antenna device by stacking a support body including a spacer and an antenna element of a dipole antenna.

DESCRIPTION OF EMBODIMENTS

First Embodiment

Figure 1:
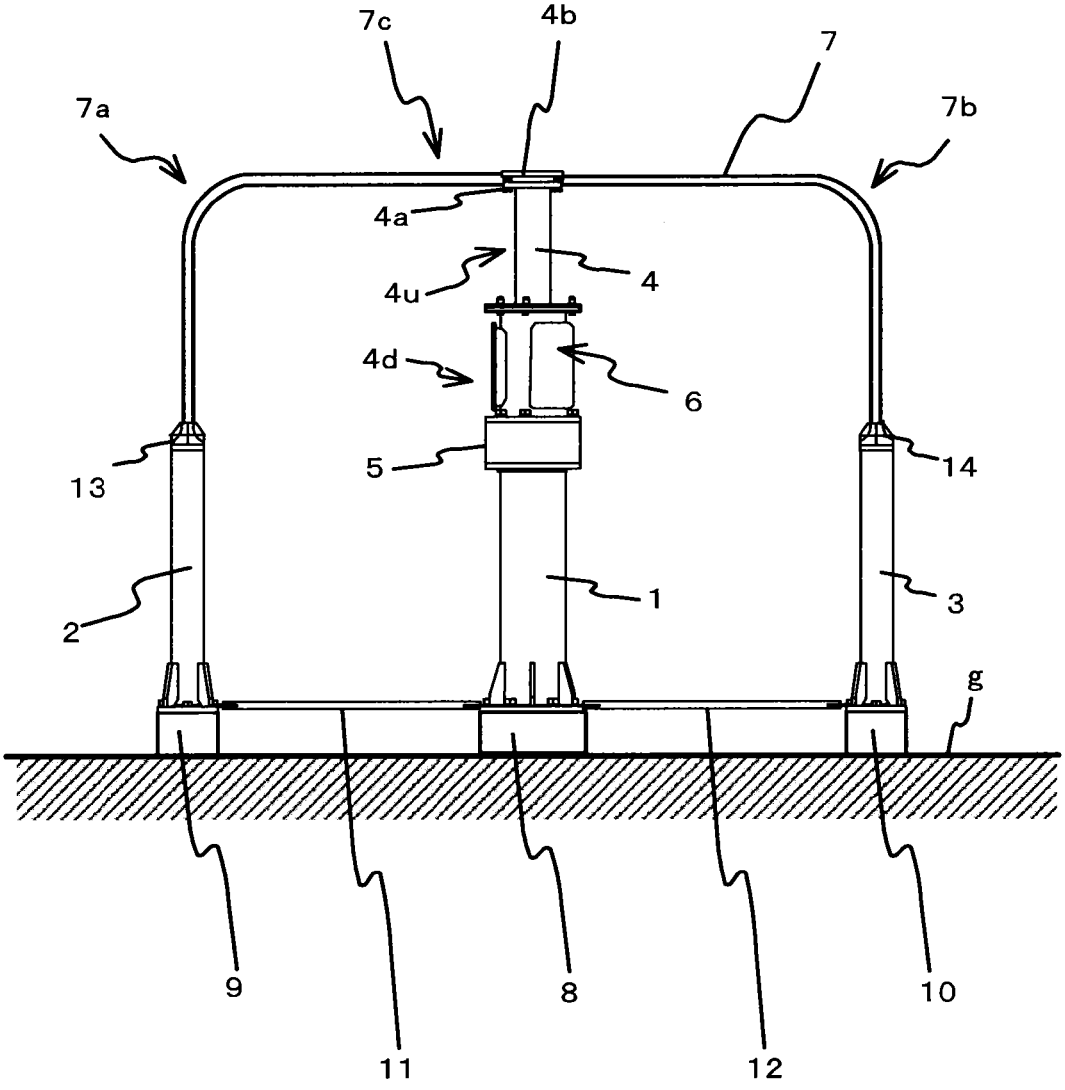
FIG. 1 is a front view of an antenna device according to a first embodiment of the present disclosure.
Figure 2:
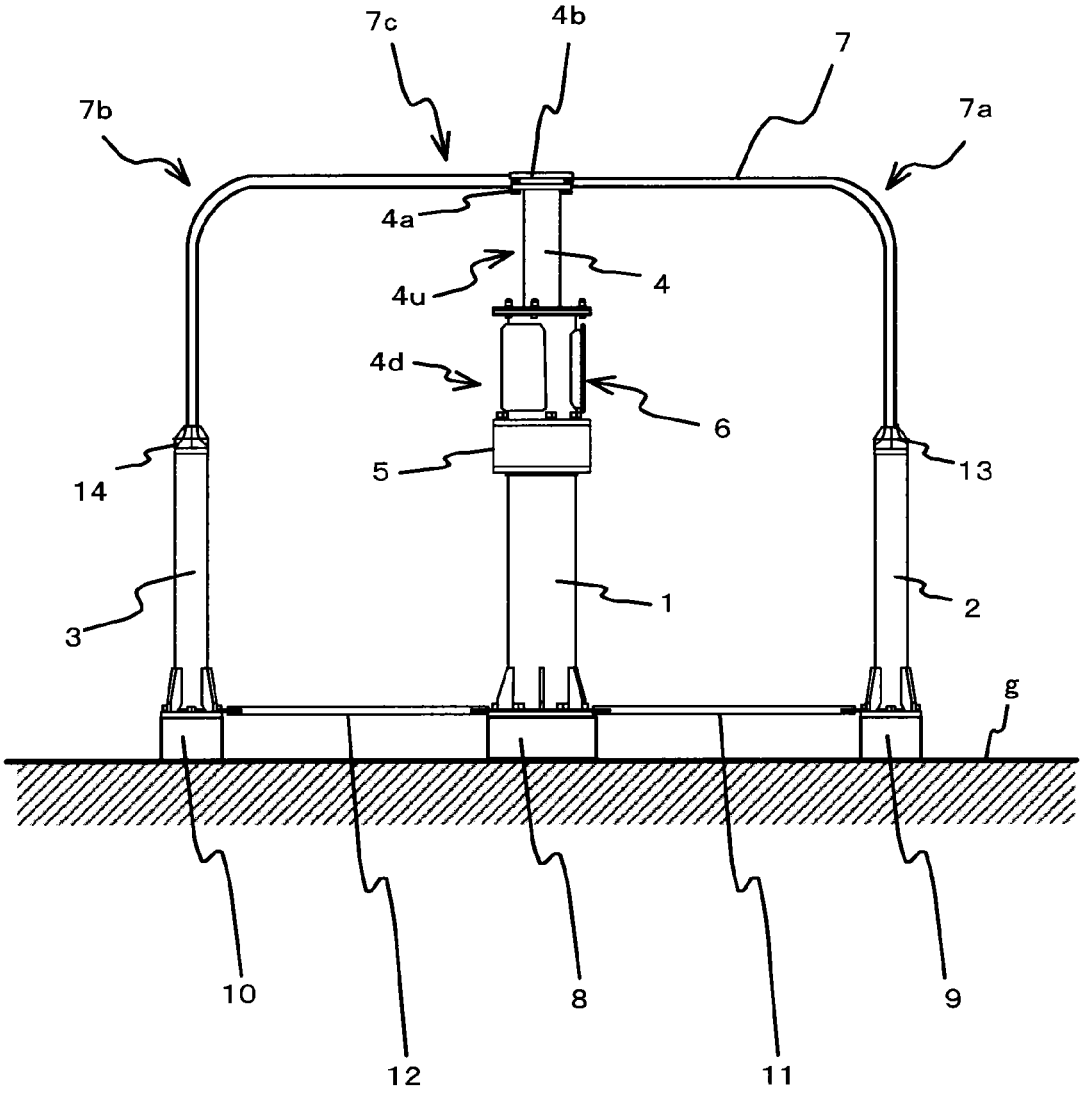
FIG. 2 is a back view of the antenna device according to the first embodiment.
Figure 3:
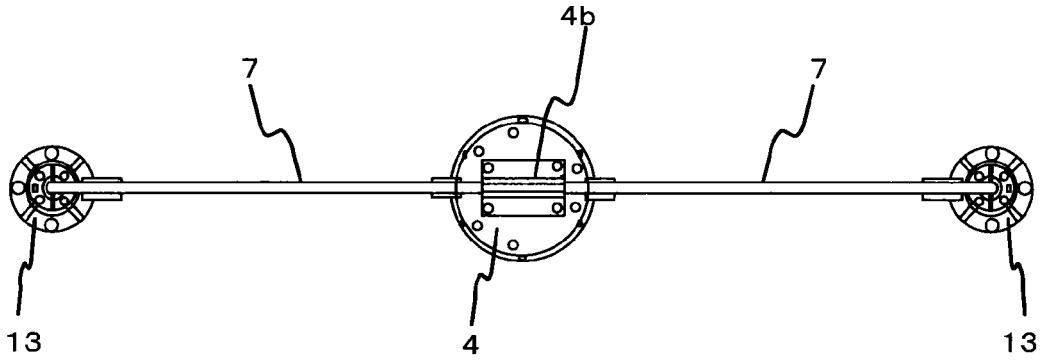
FIG. 3 is a top view of the antenna device according to the first embodiment.
Figure 4:
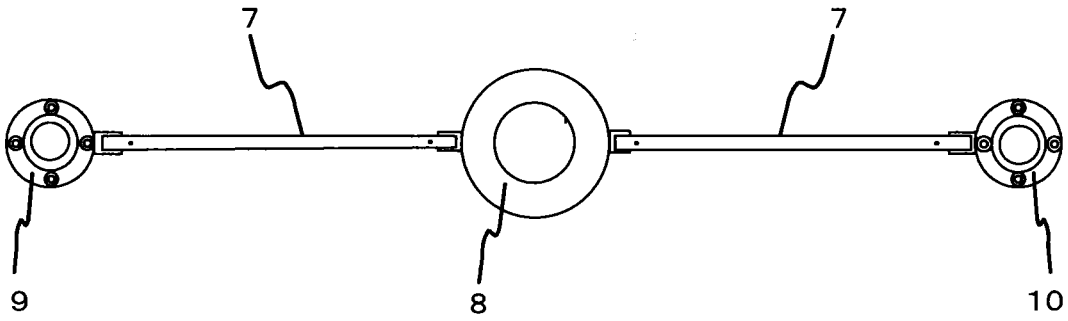
FIG. 4 is a bottom view of the antenna device according to the first embodiment.
Figure 5:
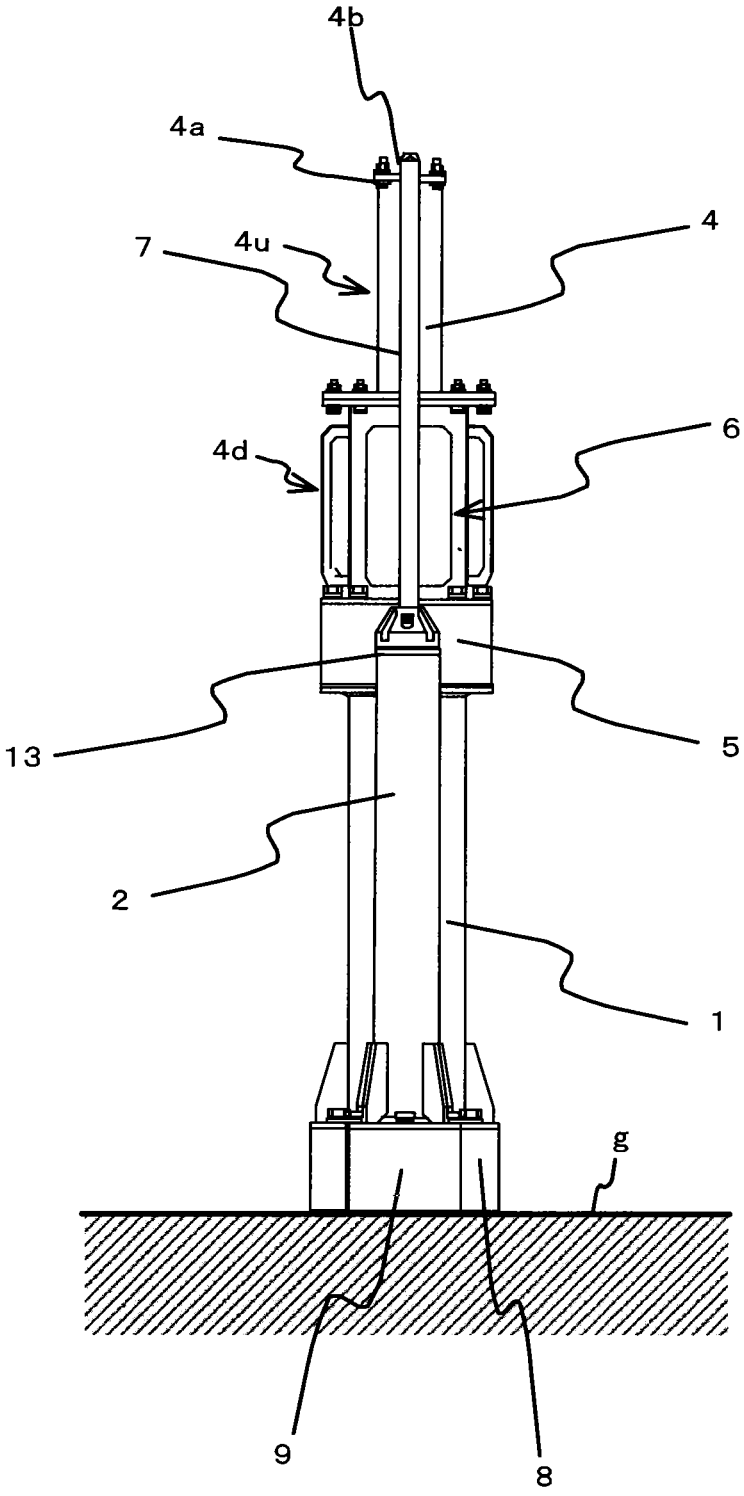
FIG. 5 is a left side view of the antenna device according to the first embodiment.
Figure 6:
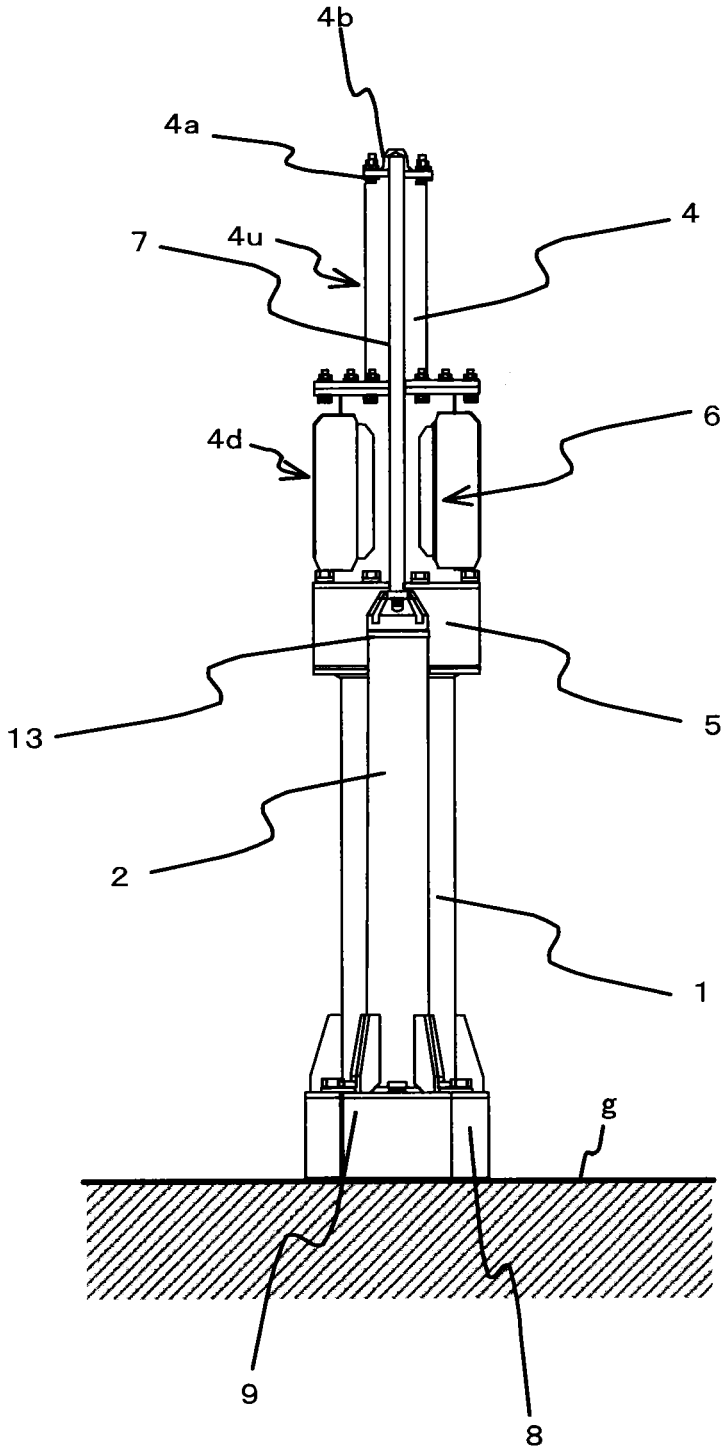
FIG. 6 is a right side view of the antenna device according to the first embodiment.
Figure 7A:
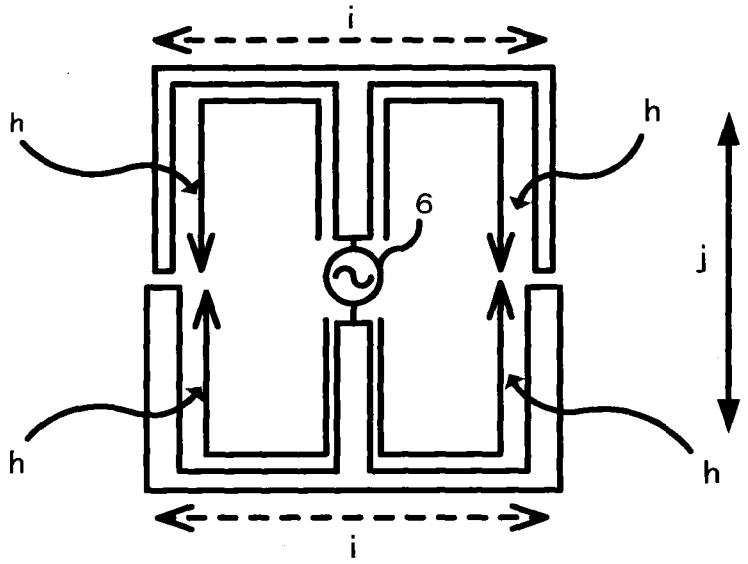
FIG. 7A is a schematic diagram illustrating a (first) current path of the antenna device according to the first embodiment.
Figure 7B:
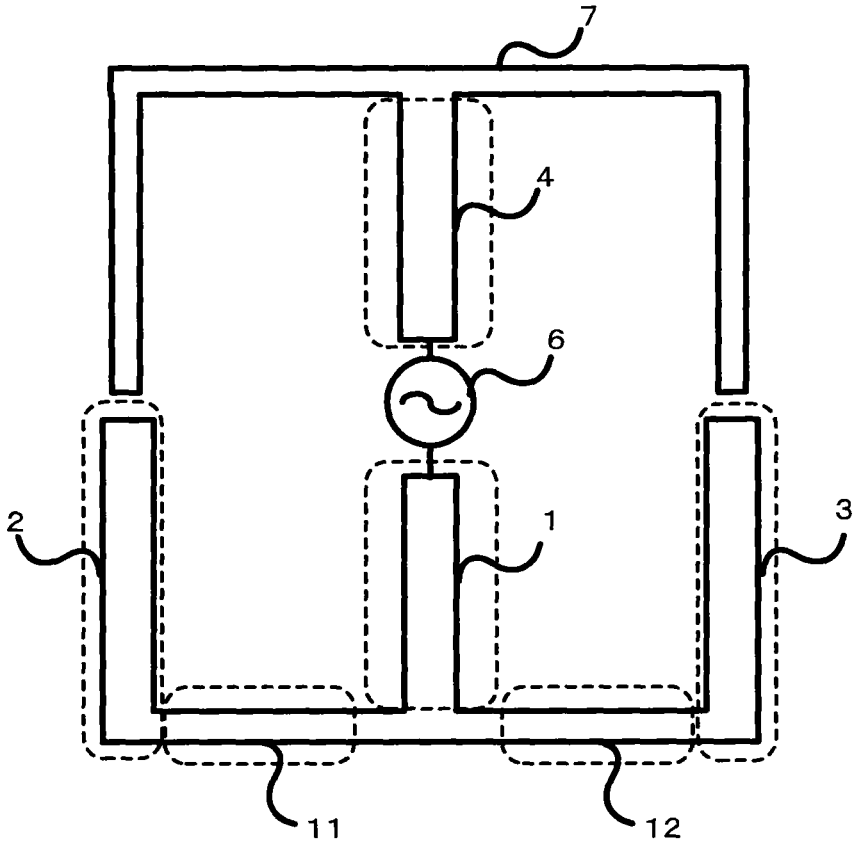
FIG. 7B is a schematic diagram illustrating a (second) current path of the antenna device according to the first embodiment.

A first embodiment of the present disclosure is explained below with reference to FIGS. 1-13. FIGS. 1-6 each illustrate an antenna device according to the first embodiment of the present disclosure. FIG. 7A is a schematic diagram illustrating a current path of the antenna device. FIG. 7B is a diagram illustrating correspondence relationship between the schematic diagram of FIG. 7A and the reference numerals given to the antenna device of the first embodiment. FIGS. 7A and 7B schematically illustrate the antenna device of FIGS. 1-6. FIGS. 8-11 illustrate sequential assembling procedures of a method for installing an antenna device. FIG. 12B is a front view of the antenna device. FIG. 12A is an enlarged cross-sectional view of a dashed-line part of the antenna device in the front view of FIG. 12B. The cross-sectional view of FIG. 12A illustrates a columnar conductor and a U-shaped conductor, each divided into two pieces in the vertical direction, which is perpendicular to the plane of the planar view of FIG. 2 is viewed. In other words, the columnar conductor and the U-shaped conductor are each divided into two pieces in the respective directions in which the columnar conductor and the U-shaped conductor extend. An expected installation surface g for the antenna device of the first embodiment is the ground, the roof of a building, or the like. The antenna device of this embodiment is an example antenna device of the present disclosure, and the present disclosure is not limited to the examples explained in following embodiments.

As illustrated in FIGS. 1-13, a first main columnar conductor 1 is arranged between a first columnar sub-conductor 2 and a second columnar sub-conductor 3 (intermediate position) arranged in parallel with the first columnar sub-conductor 2. That is, the first main columnar conductor 1 is disposed at the intermediate position between the first columnar sub-conductor 2 and the second columnar sub-conductor 3. In addition, the first main columnar conductor 1 is connected electrically with the first columnar sub-conductor 2 and the second columnar sub-conductor 3. An upper center dielectric spacer 5 is mounted on the tip portion of the first main columnar conductor 1. A second main columnar conductor 4 is disposed in series (linearly) so as to face the first main columnar conductor 1 via the upper center dielectric spacer 5. A power feeding portion (power feeding point) 6 is connected electrically with the first main columnar conductor 1 and the second main columnar conductor 4. A U-shaped conductor 7 is bent in a U-shape. One end of the U-shaped conductor 7 faces the tip portion of the first columnar sub-conductor 2. The other end of the U-shaped conductor 7 faces the tip portion of the second columnar sub-conductor 3. A central portion 7*c* of the U-shaped conductor 7 is fastened to the tip portion of the second main columnar conductor 4. Since the second main columnar conductor 4 fixes the vicinity of the center of the central portion 7*c*, the U-shaped conductor 7 has a structure that is line-symmetric with respect to a perpendicular line passing through the vicinity of the center. In the figures, the same reference numeral indicates the same or equivalent part, and duplicated detailed explanation thereof is omitted.

As illustrated in FIGS. 1-13, the second main columnar conductor 4 includes a first plate-like conductor (upper flange) 4*a* formed at the tip of the second main columnar conductor 4, and a second plate-like conductor 4*b* (attachment fitting) disposed above the first plate-like conductor 4*a*. The central portion 7*c* of the U-shaped conductor 7 is held between the first plate-like conductor 4*a* and the second plate-like conductor 4*b*. Hence, the second main columnar conductor 4 is fixed. The second plate-like conductor 4*b* is a member different from the second main columnar conductor 4. The second plate-like conductor 4*b* becomes a part of the second main columnar conductor 4 after the U-shaped conductor 7 is fastened. In addition, at least either the first plate-like conductor 4*a* or the second plate-like conductor 4*b* may be formed with a groove into which the U-shaped conductor 7 is fitted. According to the present application, the second plate-like conductor 4*b* is formed with a groove into which the U-shaped conductor 7 is fitted. Needless to say, the second plate-like conductor 4*b* may be omitted, and only the second main columnar conductor 4 may be fastened to the U-shaped conductor 7 by the first plate-like conductor 4*a* (upper flange 4*a*). In this case, when the first plate-like conductor 4*a* (upper flange 4*a*) is formed with a groove into which the U-shaped conductor 7 is fitted, the U-shaped conductor 7 can be held by the second main columnar conductor 4 easily. The straight part of the U-shaped conductor 7 includes a first straight part that extends linearly from the one end to a first bent portion 7*a*, a second straight part that extends linearly from the other end to a second bent portion 7*b*, and a central portion 7*c* that extends linearly from the first bent portion 7*a* to the second bent portion 7*b*. The first bent portion 7*a* and the second bent portion 7*b* may employ a form that is bent by 90 degrees. That is, the U-shaped conductor 7 can be also understood as an open-bottomed rectangle-shaped conductor 7. In the figures, the same reference numeral indicates the same or equivalent part, and duplicated detailed explanation thereof is omitted.

As illustrated in FIGS. 1-13, a lower center dielectric spacer 8 is mounted on the installation surface g. A first lower dielectric spacer 9 and a second lower dielectric spacer 10 are each mounted on the installation surface g, and the lower center dielectric spacer 8 is disposed therebetween (intermediate position). The first lower dielectric spacer 9, the second lower dielectric spacer 10, and the lower center dielectric spacer 8 may be an integral dielectric spacer. In addition, the first lower dielectric spacer 9, the second lower dielectric spacer 10, and the lower center dielectric spacer 8 may be buried in the installation surface g. The installation surface g itself may have the respective functions (dielectric spacer) of the lower center dielectric spacer 8, the first lower dielectric spacer 9, and the second lower dielectric spacer 10. A first connection conductor 11 connects electrically the first columnar sub-conductor 2 with the first main columnar conductor 1. A second connection conductor 12 connects electrically the second columnar sub-conductor 3 with the first main columnar conductor 1. The first connection conductor 11 and the second connection conductor 12 have the same length. The first connection conductor 11 and the second connection conductor 12 can also serve as reinforcement that allows the first main columnar conductor 1, the first columnar sub-conductor 2, and the second columnar sub-conductor 3 to stand upright. A first upper dielectric spacer 13 is formed at the tip portion of the first columnar sub-conductor 2. A second upper dielectric spacer 14 is formed at the tip portion of the second columnar sub-conductor 3. The first upper dielectric spacer 13 and the second upper dielectric spacer 14 are each, for example, formed in a conical shape that is a shape having tapered upper portion. In particular, as illustrated in FIG. 12A, the upper dielectric spacer 14 includes an upper conical portion and a lower columnar portion. The diameter of the bottom of the conical portion is consistent with the diameter of the columnar portion. In the figures, the same reference numeral indicates the same or equivalent part, and duplicated detailed explanation thereof is omitted.

Structure of the antenna device according to the first embodiment is described below. The antenna device of the first embodiment is a dipole antenna. As illustrated in FIG. 1 to FIG. 6, the one side antenna element (exciter part (metal part)) of the dipole antenna includes three columnar conductors. These three columnar conductors become parts of a lower-side antenna element and a one side antenna element. The first columnar conductor is the first main columnar conductor 1. The first main columnar conductor 1 has a base-end portion fastened to the lower center dielectric spacer 8 mounted on the installation surface g, and stands upright. The second columnar conductor is the first columnar sub-conductor 2. The first columnar sub-conductor 2 has a base-end portion fastened to the first lower dielectric spacer 9 in the first lower dielectric spacer 9 and the second lower dielectric spacer 10 having the lower center dielectric spacer 8 disposed therebetween and mounted on the installation surface g, and stands upright. The third columnar conductor is the second columnar sub-conductor 3. The second columnar sub-conductor 3 has a base-end portion fastened to the second lower dielectric spacer 10, and stands upright. These three columnar conductors are connected electrically together through the first connection conductor 11 and the second connection conductor 12 in the vicinities of the lower center dielectric spacer 8, the first lower dielectric spacer 9 and the second lower dielectric spacer 10.

As illustrated in FIGS. 1-6, the other antenna element (exciter part (metal part)) of the dipole antenna that is the antenna device of the first embodiment includes two columnar conductors. Those two columnar conductors become parts of an upper-side antenna element, and the other side antenna element. The first columnar conductor is the second main columnar conductor 4. The second main columnar conductor 4 has a base-end portion fastened to a surface of the upper center dielectric spacer 5 opposite to the surface mounted on the tip portion of the first main columnar conductor 1, and stands upright. The second columnar conductor is the U-shaped conductor 7. The U-shaped conductor 7 is bent in the U-shape, has one end fastened to the first upper dielectric spacer 13, has the other end fastened to the second upper dielectric spacer 14, and has the central portion 7*c* fastened to the tip portion of the second main columnar conductor 4. The second main columnar conductor 4 includes two members. The first member is an upper-side second main columnar conductor 4*u* formed with the first plate-like conductor 4*a*. The other member is a lower-side second main columnar conductor 4*d* built in the power feeding portion 6. Note that the power feeding portion 6 is connected electrically with the first main columnar conductor 1 and the second main columnar conductor 4. For example, an external conductor of a coaxial line disposed at the power feeding portion 6 is connected electrically with the first main columnar conductor 1. In addition, a central conductor of the coaxial line disposed at the power feeding portion 6 is connected electrically with the second main columnar conductor 4. An example connection scheme is disclosed in the above-explained Patent Literature 1 (in particular, FIGS. 2-7 of Patent Literature 1).

In the present application, an example power feeding portion 6 is explained which is built in the lower-side second main columnar conductor 4*d* side of the second main columnar conductor 4. Hence, from the lower center dielectric spacer 8 side, the first main columnar conductor 1, the upper center dielectric spacer 5, the lower-side second main columnar conductor 4*d*, and the upper-side second main columnar conductor 4*u* are disposed (fastened) in this order. Needless to say, the power feeding portion 6 may be wired from the exterior of the first main columnar conductor 1 and that of the second main columnar conductor 4 (for example, a coaxial line), or may be built in the first main columnar conductor 1. When the power feeding portion 6 is contained within the first main columnar conductor 1, the first main columnar conductor 1 is preferably constructed as two members, that is, a lower-side first main columnar conductor at the lower center dielectric spacer 8 side, and an upper-side first main columnar conductor containing the power feeding portion 6. In this configuration, these components are arranged (fastened), in order, from the lower center dielectric spacer 8 side as the lower-side first main columnar conductor, the upper-side first main columnar conductor, the upper center dielectric spacer 5, and the second main columnar conductor 4. In this configuration, the second main columnar conductor 4 may be one columnar conductor.

According to the antenna device of the first embodiment, the first columnar sub-conductor 2, the second columnar sub-conductor 3, the first main columnar conductor 1, the second main columnar conductor 4 and the U-shaped conductor 7 can be made lightweight by using hollow conductor bar (metal bar, metal pipe). The first columnar sub-conductor 2, the second columnar sub-conductor 3, the first main columnar conductor 1, the second main columnar conductor 4 and the U-shaped conductor 7 are each a hollow metal bar, and constitute an exciter of the dipole antenna.

In addition, the U-shaped conductor 7 is supported by the second main columnar conductor 4. Hence, the U-shaped conductor 7 can have a smaller diameter than those of the first columnar sub-conductor 2, the second columnar sub-conductor 3, the first main columnar conductor 1, and the second main columnar conductor 4. Still further, the U-shaped conductor 7 can have a small-diameter, and can be lightweight. In this respect, the U-shaped conductor is different from the first columnar sub-conductor 2, the second columnar sub-conductor 3, the first main columnar conductor 1 and the second main columnar conductor 4, which greatly contribute to the self-support of the antenna device of the first embodiment or self-support by the aid of a guy wire. Respective distal portions (portions directed toward the installation surface g) of the first bent portion 7*a* and the second bent portion 7*b* are also supported by the first columnar sub-conductor 2 and the second columnar sub-conductor 3, respectively, via the first upper dielectric spacer 13 and the second upper dielectric spacer 14.

Likewise, the first connection conductor 11 and the second connection conductor 12 can have a smaller diameter than those of the first columnar sub-conductor 2, the second columnar sub-conductor 3, the first main columnar conductor 1 and the second main columnar conductor 4. In this respect, the first and second connection conductors are different from the first columnar sub-conductor 2, the second columnar sub-conductor 3, the first main columnar conductor 1 and the second main columnar conductor 4, which contribute to the self-support of the antenna device of the first embodiment or self-support by the aid of a guy wire. In addition, the first connection conductor 11 and the second connection conductor 12 can have a small-diameter and can be lightweight. The first connection conductor 11 and the second connection conductor 12 each can be hollow. However, when the first connection conductor 11 and the second connection conductor 12 are used in order to maintain the distance relationship (positional relationship) between the first columnar sub-conductor 2, the second columnar sub-conductor 3 and the first main columnar conductor 1, the first connection conductor 11 and the second connection conductor 12 need a certain level of strength.

The structure of the antenna device of the first embodiment is explained below in further detail. As illustrated in FIGS. 1-6, the first main columnar conductor 1 has a lower flange formed at the base-end portion, and has an upper flange formed at the tip portion. The upper-side second main columnar conductor 4*u* has a lower flange formed at the base-end portion, and has the upper flange 4*a* formed at the tip portion. The lower-side second main columnar conductor 4*d* has a lower flange formed at the base-end portion, and has an upper flange formed at the tip portion. The first columnar sub-conductor 2 has a lower flange formed at the base-end portion, and has a mount part (upper flange) which is formed at the tip portion, and on which the first upper dielectric spacer 13 can be mounted. The second columnar sub-conductor 3 has a lower flange formed at the base-end portion, and has a mount part (upper flange) which is formed at the tip portion, and on which the second upper dielectric spacer 14 can be mounted. The first upper dielectric spacer 13 is formed with a hole (recess) in a surface opposite to the surface mounted on the tip portion of the first columnar sub-conductor 2, and the one end of the U-shaped conductor 7 is fitted in this recess. The second upper dielectric spacer 14 is formed with a hole (recess) in a surface opposite to the surface mounted on the tip portion of the second columnar sub-conductor 3, and the other end of the U-shaped conductor 7 is fitted in this recess.

As illustrated in FIGS. 1-6, in the second main columnar conductor 4, the lower flange of the upper-side second main columnar conductor 4*u* and the upper flange of the lower-side second main columnar conductor 4*d* are fastened to each other directly by fasteners such as bolts. The upper flange 4*a* of the upper-side second main columnar conductor 4*u* and the U-shaped conductor 7 are connected to each other by the attachment fitting 4*b*. The upper flange 4*a* (first plate-like conductor) and the attachment fitting 4*b* (second plate-like conductor) are fastened together by fasteners such as bolts. The upper center dielectric spacer 5, the lower center dielectric spacer 8, the first lower dielectric spacer 9 and the second lower dielectric spacer 10 are each a hollow dielectric (dielectric spacer). The upper center dielectric spacer 5, to which upper flange of the first main columnar conductor 1 is fixed, does not establish electrical conduction between the upper flange of the first main columnar conductor 1 and the lower flange of the lower-side second main columnar conductor 4*d*. The upper flange of the first main columnar conductor 1 and the lower flange of the lower-side second main columnar conductor 4*d* are fastened to respective facing surfaces of the upper center dielectric spacer 5 by fasteners such as bolts. The lower flange of the first main columnar conductor 1 is fastened to the facing surface of the lower center dielectric spacer 8 by fasteners such as bolts. Likewise, the respective lower flanges of the first columnar sub-conductor 2 and the second columnar sub-conductor 3 are fastened to the respective facing surfaces of the first lower dielectric spacer 9 and the second lower dielectric spacer 10 by fasteners such as bolts.

As explained above, the respective lower flanges of the first main columnar conductor 1, the first columnar sub-conductor 2 and the second columnar sub-conductor 3 are fastened to the lower center dielectric spacer 8, the first lower dielectric spacer 9 and the second lower dielectric spacer 10 by fasteners such as bolts. The first connection conductor 11 is formed between the lower flange of the first main columnar conductor 1 and that of the first columnar sub-conductor 2, and is fastened to the lower flange of the first main columnar conductor 1 and that of the first columnar sub-conductor 2 by fasteners such as bolts. The second connection conductor 12 is formed between the lower flange of the first main columnar conductor 1 and that of the second columnar sub-conductor 3, and is fastened to the lower flange of the first main columnar conductor 1 and that of the second columnar sub-conductor 3 by fasteners such as bolts. The first upper dielectric spacer 13, to which one end of the U-shaped conductor 7 is fixed to, maintains a certain distance and does not establish electrical conduction between the upper flange (mount part) of the first columnar sub-conductor 2 and one end of the U-shaped conductor 7. The second upper dielectric spacer 14, to which the other end of the U-shaped conductor 7 is fixed to, maintains a certain distance and does not establish electrical conduction between the upper flange (mount part) of the second columnar sub-conductor 3 and the other end of the U-shaped conductor 7.

According to such a structure, the antenna device of the first embodiment can easily realize a short-height antenna device that has a simple structure. In addition, an antenna device that can stand upright on the installation surface g using a small number of guy wires, or an antenna device can be obtained easily that is self-supporting and does not use guy wires.

Next, operating and size reduction of the antenna device according to the first embodiment are explained with reference to FIG. 7A and FIG. 7B. FIG. 7A and FIG. 7B correspond to the front view (FIG. 1) of the antenna device of the first embodiment, and are diagrams schematically illustrating the exciter part (metal part, antenna element) and the power feeding portion 6. When power is supplied so as to produce a potential difference between both ends of the power feeding point 6 of the antenna device, a current flows through a current path h indicated by a thick-line arrow. In general, as this current path length becomes shorter than the quarter wavelength, the gain of the dipole antenna further decreases. Hence, according to the antenna device of the first embodiment, the exciter part is bent to ensure the current path length and to suppress the gain reduction of the antenna, while at the same time downsizing the antenna device. FIG. 7B clarifies the correspondence relationship with the specific structural elements of the antenna device illustrated in FIGS. 1-6, and the illustrated structural elements are distinguished from one another by dashed lines.

In addition, FIG. 7A illustrates a current vector i produced in the horizontal direction of the exciter at a certain moment and indicated by a dashed-line arrow. According to the structure of the antenna device of the first embodiment, the first main columnar conductor 1 is disposed at the intermediate position between the first columnar sub-conductor 2 and the second columnar sub-conductor 3, and the U-shaped conductor 7 is linearly symmetric with respect to a line passing through the vicinity of the center of the central portion 7*c* fastened by the second main columnar conductor 4. That is, the configuration of the antenna device of the first embodiment has bilateral symmetry with respect to the first main columnar conductor 1 and the second main columnar conductor 4 arranged in series (linearly) via the upper center dielectric spacer 5, and thus these current vectors always cancel one another in the lateral direction.

Hence, according to the structure of the antenna device of the first embodiment, a high-gain and compact antenna device can be obtained that has the vertical direction as a main polarization direction j. According to the structure of the antenna device of the first embodiment, a dipole antenna can be obtained that, by the bilaterally symmetric configuration, maintains gain of the main polarized wave of the dipole antenna and suppresses gain of the cross polarized wave.

Figure 8:
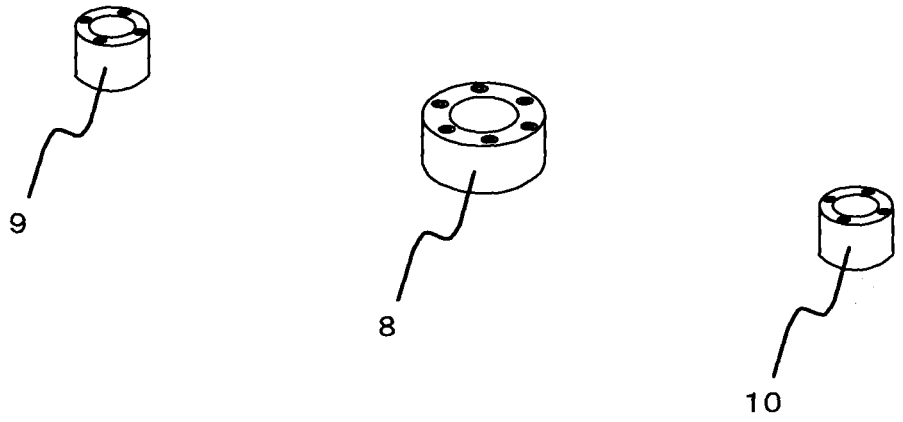
FIG. 8 is an explanatory diagram illustrating a (first) assembling procedure of a method for installing the antenna device according to the first embodiment.

Next, an installation method (assembling procedure) of the antenna device according to the first embodiment is explained with reference to FIGS. 8-13. FIG. 8 illustrates a lower-dielectric-spacer mounting process of the installation method of the antenna device of the first embodiment. This lower-dielectric-spacer mounting process is a process of mounting the first lower dielectric spacer 9, the second lower dielectric spacer 10, and the lower center dielectric spacer 8 on the installation surface g. At this time, the first lower dielectric spacer 9, the second lower dielectric spacer 10, and the lower center dielectric spacer 8 can be fastened to the installation surface g. However, when the first columnar sub-conductor 2, the second columnar sub-conductor 3, and the first main columnar conductor 1 are set up, these spacers may be fastened to the installation surface g simultaneously with the setup of the first columnar sub-conductor 2, the second columnar sub-conductor 3, and the first main columnar conductor 1. When the first lower dielectric spacer 9, the second lower dielectric spacer 10, and the lower center dielectric spacer 8 are disposed on (fastened to) the installation surface g before the installation of the antenna device, or when the installation surface g functions as the dielectric spacer, the lower-dielectric-spacer mounting process becomes unnecessary.

Figure 9:
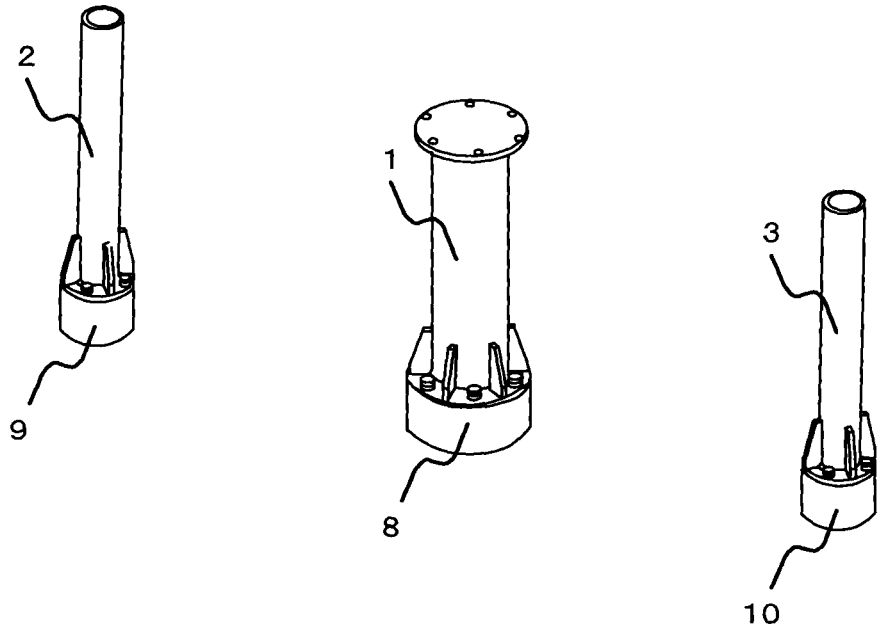
FIG. 9 is an explanatory diagram illustrating a (second) assembling procedure of the method for installing the antenna device according to the first embodiment.

FIG. 9 illustrates a lower-side-columnar-conductor installing process of the installation method of the antenna device according to the first embodiment. This lower-side-columnar-conductor installing process is a process of setting up the first columnar sub-conductor 2, the second columnar sub-conductor 3, and the first main columnar conductor 1 on the installation surface g, respectively, and disposing the first main columnar conductor 1 between the first columnar sub-conductor 2 and the second columnar sub-conductor 3. When the lower-dielectric-spacer mounting process is necessary for the installation method of the antenna device according to the first embodiment, the lower-dielectric-spacer mounting process of mounting the first lower dielectric spacer 9, the second lower dielectric spacer 10, and the lower center dielectric spacer 8 on the installation surface g are necessary to be carried out prior to the lower-side-columnar-conductor installing process. The lower-side-columnar-conductor installing process is a process of fastening the respective base-end portions of the first columnar sub-conductor 2, the second columnar sub-conductor 3, and the first main columnar conductor 1 to the first lower dielectric spacer 9, the second lower dielectric spacer 10, and the lower center dielectric spacer 8 mounted on the installation surface g.

Figure 10:
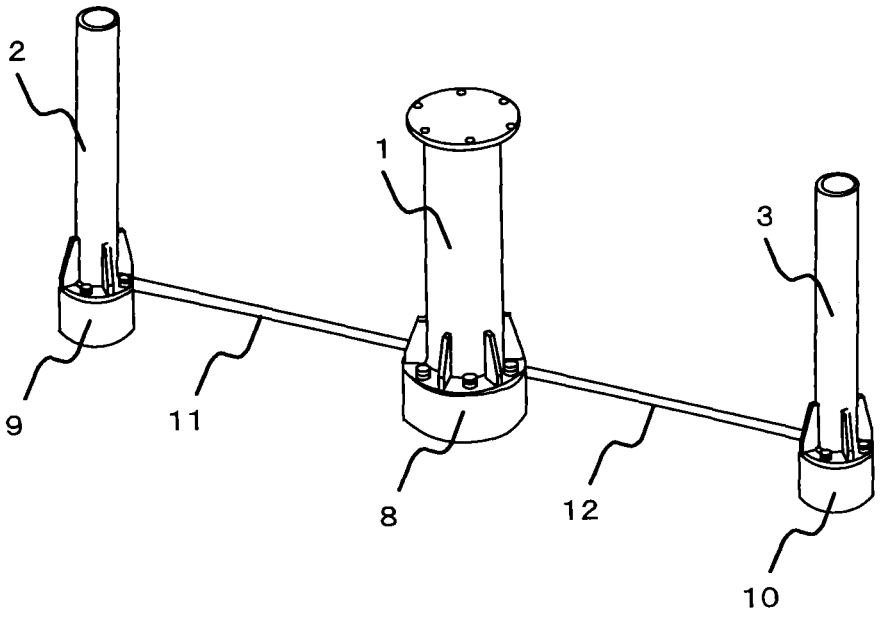
FIG. 10 is an explanatory diagram illustrating a (third) assembling procedure of the method for installing the antenna device according to the first embodiment.

FIG. 10 illustrates a lower-side-columnar-conductor electrical connecting process in the installation method of the antenna device according to the first embodiment. This lower-side-columnar-conductor electrical connecting process is a process of connecting electrically the first columnar sub-conductor 2 and the second columnar sub-conductor 3 with the first main columnar conductor 1. More specifically, the lower-side-columnar-conductor electrical connecting process includes a step of connecting the first main columnar conductor 1 with the first columnar sub-conductor 2 through the first connection conductor 11, and a step of connecting the first main columnar conductor 1 with the second columnar sub-conductor 3 through the second connection conductor 12. The steps of the lower-side-columnar-conductor electrical connecting process can be performed in any order. The lower-side-columnar-conductor electrical connecting process can be carried out after a U-shaped-conductor fastening process and a wiring process to be discussed later. In addition, the lower-side-columnar-conductor electrical connecting process performs reinforcement by the first connection conductor 11 and the second connection conductor 12, and thus the lower-side-columnar-conductor electrical connecting process can be also understood as a lower-side-columnar-conductor reinforcing process.

Figure 11:
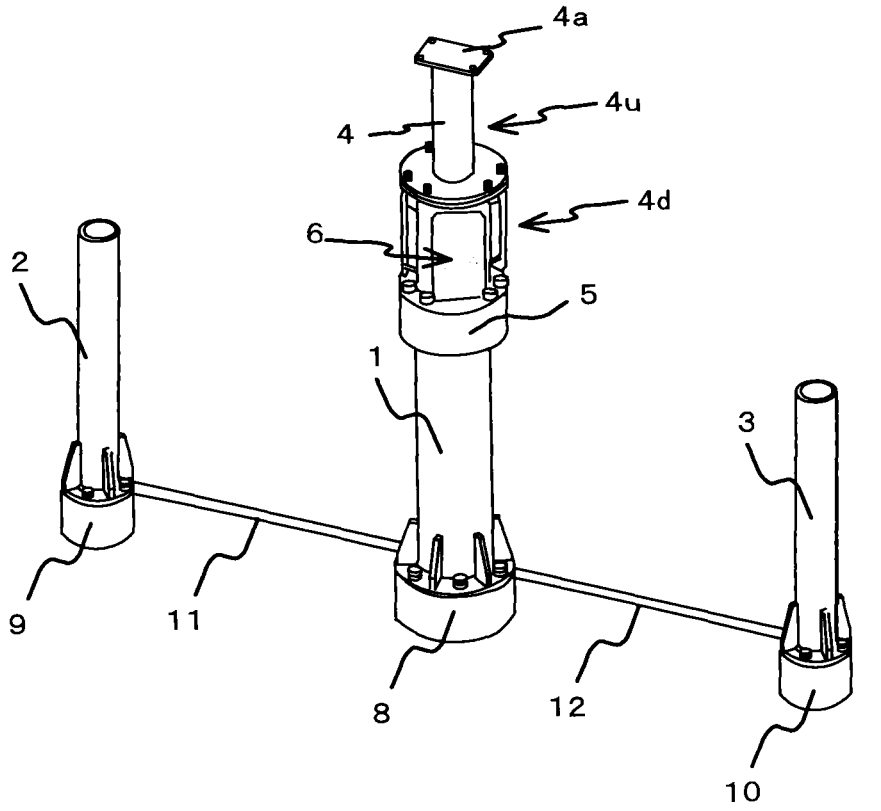
FIG. 11 is an explanatory diagram illustrating a (fourth) assembling procedure of the method for installing the antenna device according to the first embodiment.
Figure 12A:
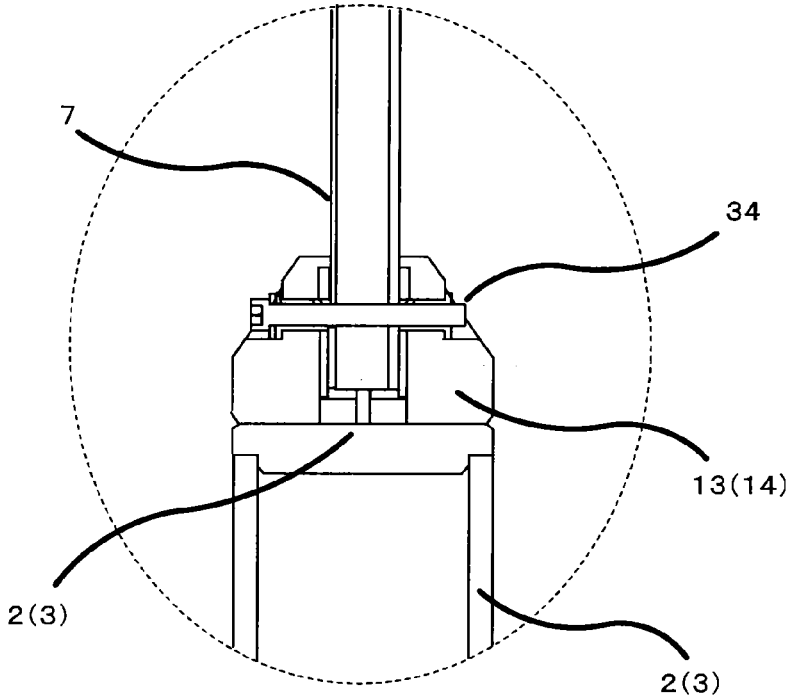
FIG. 12A is an explanatory diagram illustrating a (fifth) assembling procedure of the method for installing the antenna device according to the first embodiment.
Figure 12B:
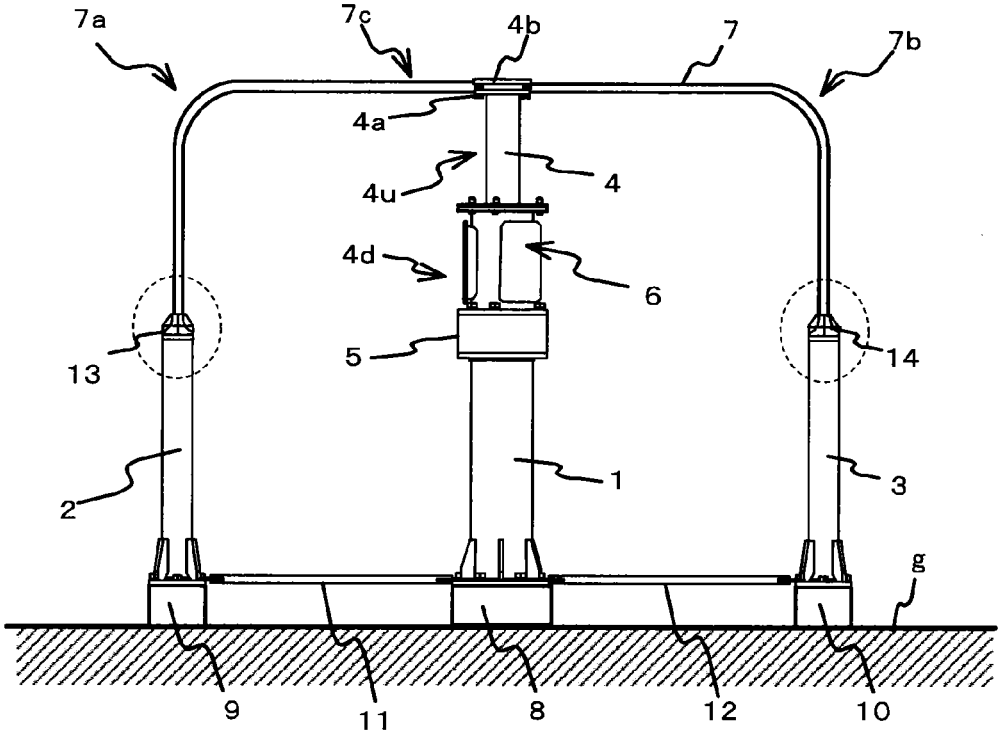
FIG. 12B is an explanatory diagram illustrating a (sixth) assembling procedure of the method for installing the antenna device according to the first embodiment.

FIG. 11 illustrates an upper-side-columnar-conductor installing process of the installation method of the antenna device according to the first embodiment. This upper-side-columnar-conductor installing process is a process of setting up the second main columnar conductor 4 by mounting (fastening) the second main columnar conductor 4 base-end portion to the surface of the upper center dielectric spacer 5 opposite to the surface of the upper center dielectric spacer 5 mounted (fastened) to the tip portion of the first main columnar conductor 1. The base-end portion of the second main columnar conductor 4 is the lower flange of the lower-side second main columnar conductor 4*d*. The upper-side-columnar-conductor installing process may be carried out before the lower-side-columnar-conductor installing process. In this case, in the lower-side-columnar-conductor installing process, the first main columnar conductor 1 connected with the second main columnar conductor 4 via the upper center dielectric spacer 5 is set up on the installation surface g. Although not illustrated in the figure, an upper-dielectric-spacer mounting process (a mounting process of the upper dielectric spacer for the main columnar conductor) of mounting (fastening) the upper center dielectric spacer 5 on the tip portion (upper flange) of the first main columnar conductor 1 is carried out prior to the upper-side-columnar-conductor installing process.

Figure 13:
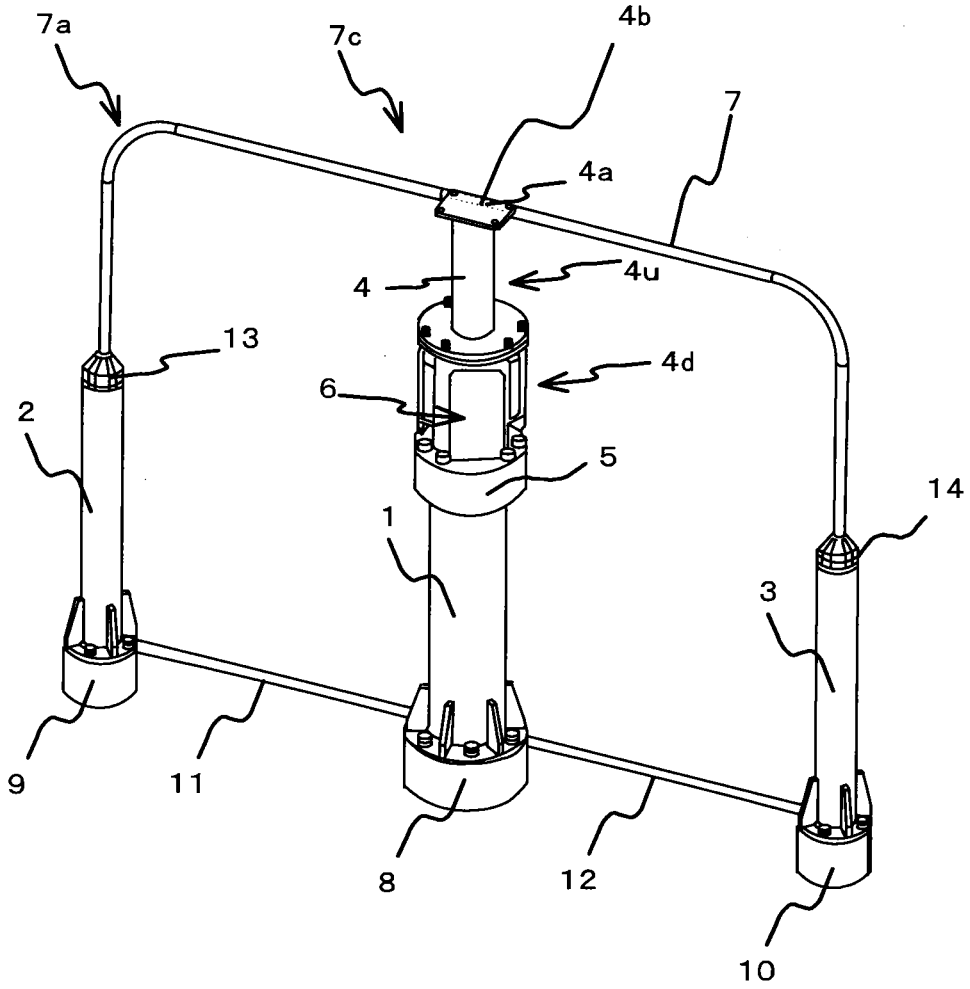
FIG. 13 is an explanatory diagram illustrating a (seventh) assembling procedure of the method for installing the antenna device according to the first embodiment.

FIGS. 12A, 12B and 13 illustrate the U-shaped-conductor fastening process in the installation method of the antenna device according to the first embodiment. In this U-shaped-conductor fastening process, the one end of the U-shaped conductor 7 bent in the U-shape is fastened to a surface of the first upper dielectric spacer 13 opposite to the surface mounted on the tip portion of the first columnar sub-conductor 2. Next, the other end of the U-shaped conductor 7 is fastened to a surface of the second upper dielectric spacer 14 opposite to the surface mounted on the tip portion of the second columnar sub-conductor 3. Still further, the central portion 7*c* of the U-shaped conductor 7 is fastened to the tip portion of the second main columnar conductor 4. In FIG. 12A, the first columnar sub-conductor 2, the second columnar sub-conductor 3, and the U-shaped conductor 7 are hollow. Likewise, in FIG. 12A, holes into which respective fasteners 34 to be discussed later are fitted are formed (opened) in the slant surface of the first upper dielectric spacer 13 and that of the second upper dielectric spacer 14 both in the conical shape. The material of the fastener 34 is not limited to any particular one as long as the strength can be ensured.

In the present application, in the U-shaped-conductor fastening process, the one end of the U-shaped conductor 7 is fitted in and fastened with the hole of the first upper dielectric spacer 13, while the other end of the U-shaped conductor 7 is fitted in and fastened with the hole of the second upper dielectric spacer 14. As illustrated in FIG. 12A, the one end of the U-shaped conductor 7 and the first upper dielectric spacer 13 are formed with respective holes in the radial direction. The one end of the U-shaped conductor 7 is fitted in the first upper dielectric spacer 13. The fastener 34 to fasten the U-shaped conductor 7 is fitted in the respective holes of the one end of the U-shaped conductor 7 and the first upper dielectric spacer 13, and thus the one end of the U-shaped conductor 7 is fastened thereto. Likewise, as illustrated in FIG. 12A, the other end of the U-shaped conductor 7 and the second upper dielectric spacer 14 are formed with respective holes in the radial direction. The other end of the U-shaped conductor 7 is fitted in the second upper dielectric spacer 14. The fastener 34 to fasten the U-shaped conductor 7 is fitted in the respective holes of the other end of the U-shaped conductor 7 and the second upper dielectric spacer 14, and thus the other end of the U-shaped conductor 7 is fastened thereto. In FIG. 12A, a screw is illustrated as the fastener 34, but the fastener 34 is not limited to a screw, and the fastener 34 may be, for example, a pin which can be inserted in and removed from freely.

In addition, as illustrated in FIG. 12A, the holes of the first upper dielectric spacer 13 and the second upper dielectric spacer 14 can be simple recesses that allow both ends of the thin U-shaped conductor 7 to be fitted therein. Accordingly, the first columnar sub-conductor 2 and the U-shaped conductor 7 (one end), without establishing electrical conduction therebetween, can be fastened by the fastener 34, and the second columnar sub-conductor 3 and the U-shaped conductor 7 (other end), without establishing electrical conduction therebetween, can be fastened by the fastener 34. Still further, the central portion 7*c* of the U-shaped conductor 7 is held between the first plate-like conductor 4*a* (upper flange 4*a* of the upper-side second main columnar conductor 4*u*) formed at the tip portion of the second main columnar conductor 4 and the second plate-like conductor 4*b* (attachment fitting 4*b*) disposed above the first plate-like conductor 4*a*, and is fastened by fasteners such as bolts.

In the U-shaped-conductor fastening process, when the respective holes of the first upper dielectric spacer 13 and second upper dielectric spacer 14 are utilized, the work can be facilitated when the one end of the U-shaped conductor 7 and the other end thereof are fastened prior to the fastening of the central portion 7*c* of the U-shaped conductor 7. For example, the one end of the U-shaped conductor 7 and the other end thereof may be fitted in the respective holes of the first upper dielectric spacer 13 and the second upper dielectric spacer 14 with the central portion 7*c* of the U-shaped conductor 7 being pushed against the tip portion (upper flange 4*a*) of the second main columnar conductor 4. In addition, the one end of the U-shaped conductor 7 and the other end thereof may be fitted in the respective holes of the first upper dielectric spacer 13 and the second upper dielectric spacer 14 with the central portion 7*c* of the U-shaped conductor 7 engaging the tip portion (upper flange 4*a*) of the second main columnar conductor 4. At this time, when the groove described above is formed in the upper flange 4*a* (first plate-like conductor 4*a*) of the second main columnar conductor 4, the U-shaped conductor 7 becomes pushed by, or engaged with, the upper flange 4*a* (first plate-like conductor 4*a*) easily. The U-shaped conductor 7 may have a structure divided symmetrically at the central portion 7*c*.

In this configuration, the U-shaped conductor 7 becomes an assembly of L-shaped conductors. With reference to the first bent portion 7*a* (second bent portion 7*b*) of both L-shaped conductors, the one end is fastened (fitted) to the first upper dielectric spacer 13 (second upper dielectric spacer 14). The other end of both L-shaped conductors is fastened by the tip portion (upper flange 4*a* (first plate-like conductor 4*a*) and the attachment fitting 4*b* (second plate-like conductor 4*b*)) of the second main columnar conductor 4. In this case, both L-shaped conductors may be joined together by fastening with the upper flange 4*a* (first plate-like conductor 4*a*) and the attachment fitting 4*b* (second plate-like conductor 4*b*). In addition, both L-shaped conductors constituting the U-shaped conductor 7 may be formed of tubular conductors, and one may be fitted in the other, thereby joining both conductors together. As a modified example, both L-shaped conductors that constitute the U-shaped conductor 7 may be formed of tubular conductors, and the U-shaped conductor 7 may be fitted in the upper flange 4*a* (first plate-like conductor 4*a*). That is, the U-shaped conductor 7 may employ a structure in which divided pieces are fastened integrally at the central portion 7*c*. The meaning of term "integral" here includes cases that can be regarded as being integrated electrically. Still further, the U-shaped conductor 7 may employ a structure in which the U-shaped conductor can be divided at the first bent portion 7*a* and the second bent portion 7*b*.

Prior to the U-shaped-conductor fastening process, although not illustrated in the figure, an upper-dielectric-spacer mounting process (upper-dielectric-spacer mounting process for the columnar sub-conductor) is carried out by mounting the first upper dielectric spacer 13 on the tip portion (upper flange) of the first columnar sub-conductor 2 and the second upper dielectric spacer 14 on the tip portion (upper flange) of the second columnar sub-conductor 3. When the first upper dielectric spacer 13 and the second dielectric spacer 14 are conically shaped as explained above, a bolt hole is opened in a lower part that has a larger diameter in the conical shape, and the first upper dielectric spacer 13 and the second dielectric spacer 14 may be fastened to the respective tips (upper flanges) of the first columnar sub-conductor 2 and the second columnar sub-conductor 3 by fasteners such as bolts.

Although not illustrated in the figure, the wiring process is carried out after the upper-side-columnar-conductor installing process (mostly, after the U-shaped-conductor fastening process). As illustrated in FIGS. 1-6, and FIGS. 8-13, when the power feeding portion 6 is disposed at the second-main-columnar-conductor-4 side, the power feeding portion 6 disposed inside the hollow second main columnar conductor 4 and the first main columnar conductor 1 are connected electrically to one another by wiring through the hollow lower center dielectric spacer 5. When the power feeding portion 6 is disposed at the first-main-columnar-conductor-1 side, the power feeding portion 6 disposed inside the hollow first main columnar conductor 1 and the second main columnar conductor 4 are connected electrically to one another by wiring through the hollow lower center dielectric spacer 5. When a coaxial line is used, the central conductor of the coaxial line is wired through the interior of the lower center dielectric spacer 5.

Hence, according to the installation method of the antenna device according to the first embodiment, a high-gain and compact antenna device can be obtained for which the main polarization direction is vertical. In addition, a dipole antenna can be obtained that maintains the gain of the main polarized wave of a dipole antenna, and by bilaterally symmetrical structure, suppresses gain of the cross polarized wave. Still further, a dipole antenna can be obtained that facilitates delivery, assembly, and installation, that requires few members for support such as guy wires, or that can stand without a support member.

Second Embodiment

Figure 14:
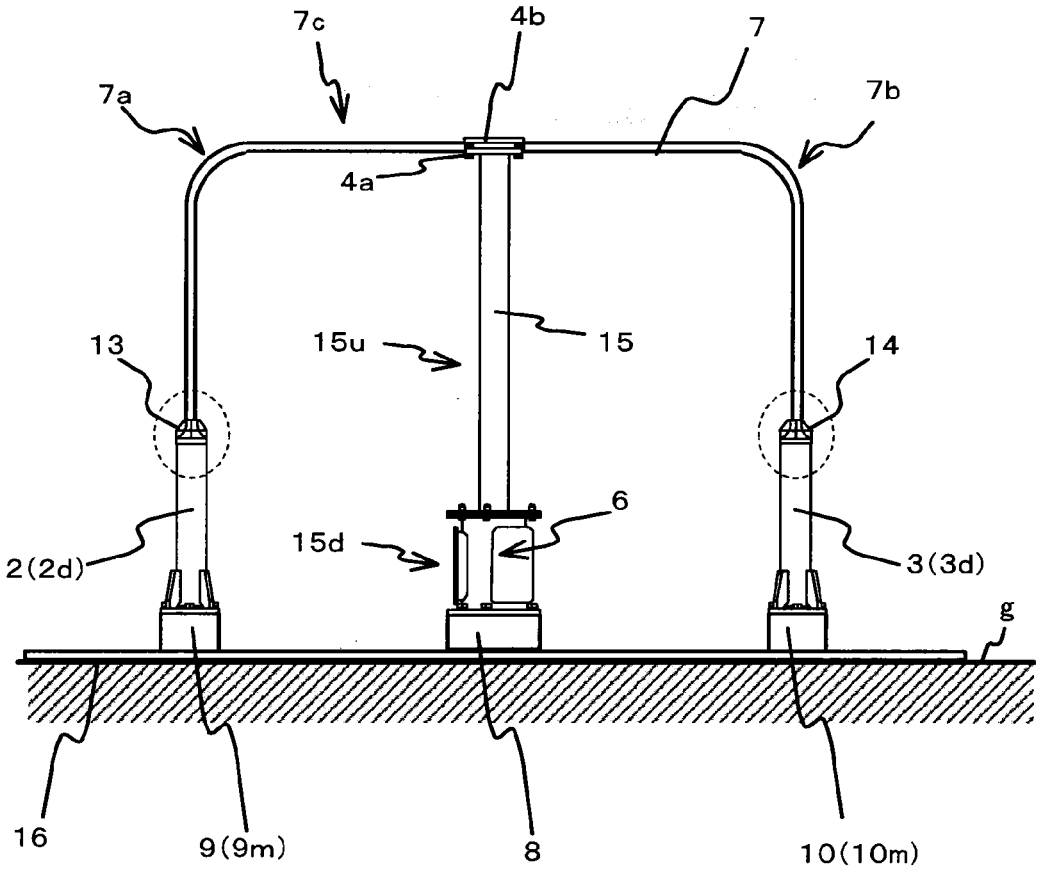
FIG. 14 is a front view of an antenna device according to a second embodiment of the present disclosure.
Figure 15:
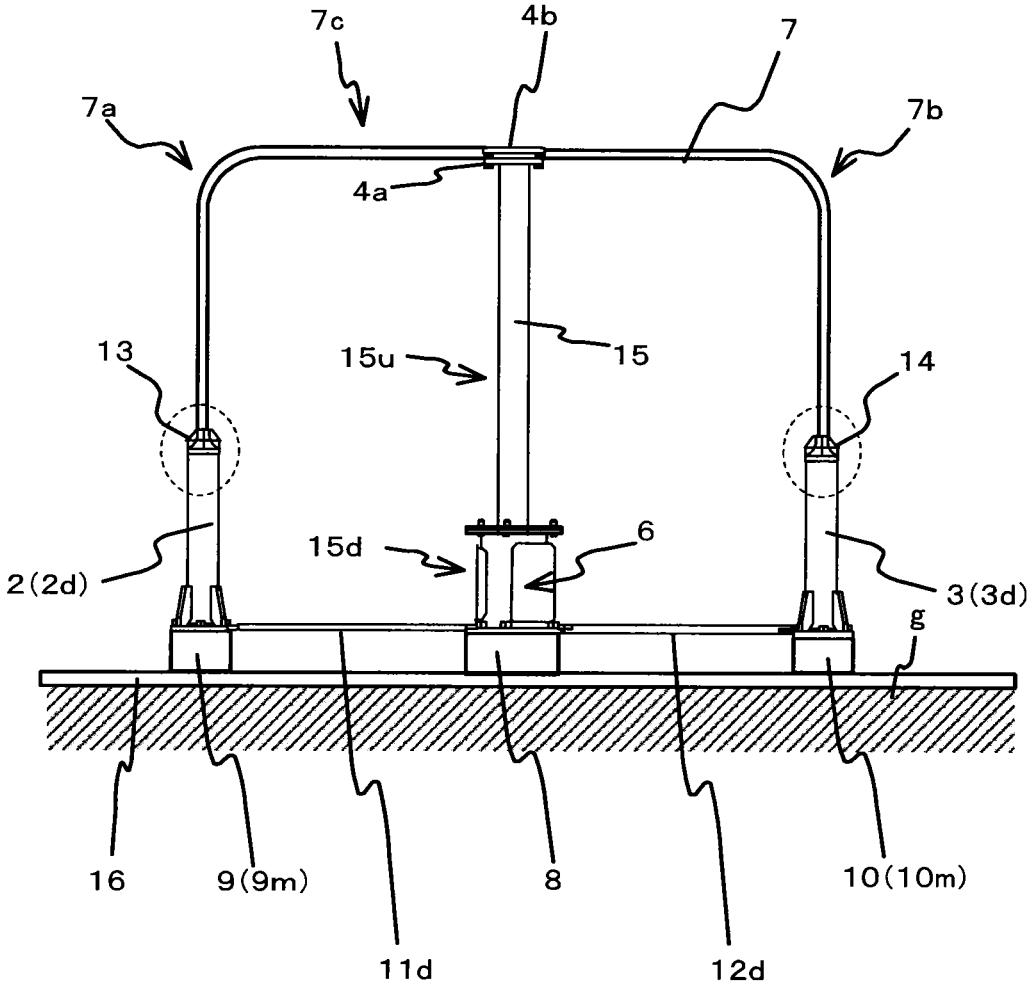
FIG. 15 is a front view of the antenna device (with reinforcement) according to the second embodiment.
Figure 16A:
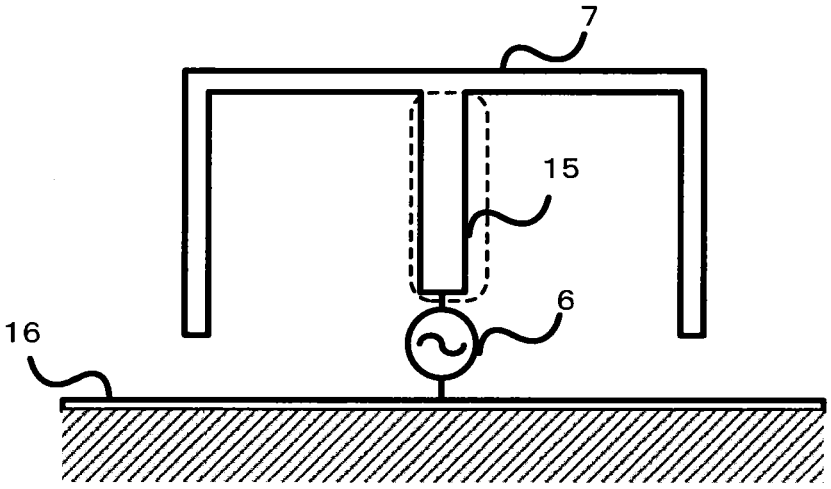
FIG. 16A is a schematic diagram illustrating a current path of the antenna device according to the second embodiment.
Figure 16B:
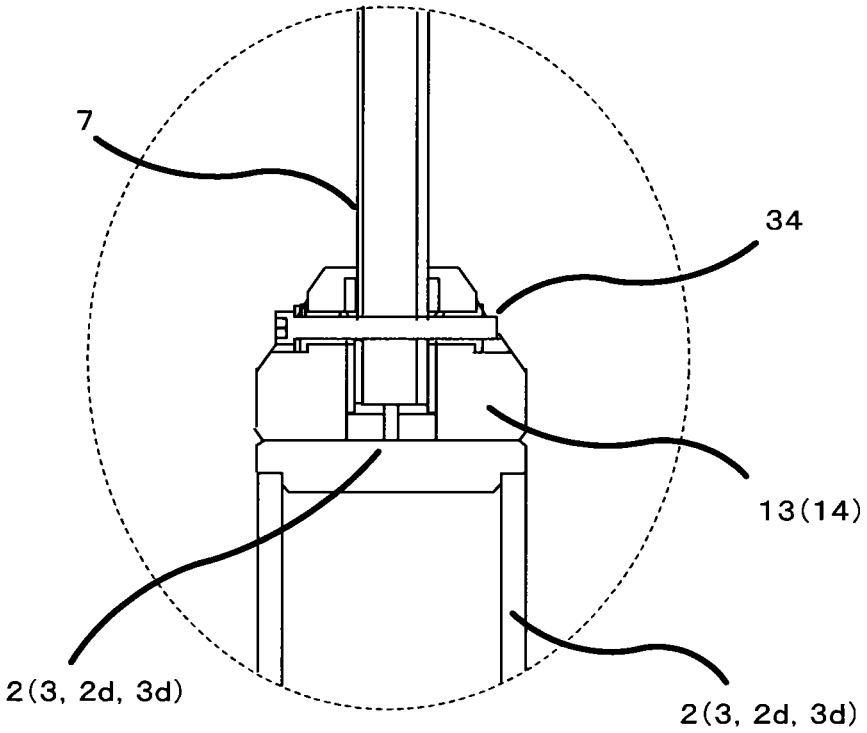
FIG. 16B is a partial enlarged cross-sectional view of the antenna device.

A second embodiment of the present disclosure is explained with reference to FIGS. 14, 15, 16A and 16B. The antenna device illustrated in FIG. 14 and the antenna device illustrated in FIG. 15 differ with respect to whether reinforcement accomplished by first connector 11*d* and second connector 12*d*, which are described later. The antenna device illustrated in FIG. 15 is reinforced by the first connector 11*d* and the second connector 12*d*, which are described later. Hence, the installation method of the antenna device illustrated in FIG. 15 includes a lower-side-columnar-conductor reinforcing (lower-side-columnar-body reinforcement) process, but the installation method of the antenna device illustrated in FIG. 14 does not include such a process. FIG. 16A is a diagram that clarifies the correspondence relationship between the specific structural element of the antenna device in FIG. 14 and that of the antenna device in FIG. 15. In FIG. 16A, the illustrated structural elements are distinguished using dashed lines. FIG. 16B is an enlarged cross-sectional view of the dashed-line part of the antenna device in the front view of FIG. 14 and of the antenna device in the front view of FIG. 15. FIG. 16B illustrates the columnar conductor and the U-shaped conductor divided into two pieces in the direction in which the planar view of FIG. 2 in the first embodiment is viewed. In other words, FIG. 16B illustrates the columnar conductor and the U-shaped conductor are each divided into two pieces in the direction in which the columnar conductor and the U-shaped conductor extend. The antenna device (and the installation method thereof) according to the first embodiment relates to a dipole antenna, but the antenna device (and installation method thereof) according to the second embodiment relates to a monopole antenna.

That is, the antenna device (and the installation method thereof) of the present application is applicable to a monopole antenna and a dipole antenna. It is expected that installation surface g for the antenna device of the second embodiment is the ground, the roof of a building, or the like. The antenna device of this embodiment is an example antenna device of the present disclosure, and the present disclosure is not limited to the examples explained in the embodiments. The description of the second embodiment explains mainly differences with respect to the first embodiment, and the explanation of common parts, such as the antenna structure and the dielectric spacer structure, is omitted occasionally.

The difference between the antenna device (and the installation method thereof) of the first embodiment and that of the second embodiment is described below. In the first embodiment, the one antenna element of the dipole antenna includes the first main columnar conductor 1, the first columnar sub-conductor 2, the second columnar sub-conductor 3, the first connection conductor 11, and the second connection conductor 12. In addition, the other antenna element of the dipole antenna includes the second columnar conductor 4, and the U-shaped conductor 7. Still further, the power feeding point 6 (power feeding portion 6) is disposed between the tip portion of the first main columnar conductor 1 and the base-end portion of the second main columnar conductor 4. In contrast, according to the second embodiment, the one antenna element of the monopole antenna includes a grounding conductor plate 16 (ground, earth). In addition, the other antenna element of the monopole antenna includes a main columnar conductor 15 (corresponding to the first main columnar conductor 1 and the second main columnar conductor 4), the first columnar sub-conductor 2 (or a first columnar sub-body 2*d* formed by an insulating member such as a dielectric), the second columnar sub-conductor 3 (or a second columnar sub-body 3*d* formed by an insulating member such as a dielectric), and the U-shaped conductor 7. Still further, the power feeding point 6 (power feeding portion 6) is disposed between the base-end portion of the main columnar conductor 15 and the grounding conductor plate 16. The antenna device illustrated in FIG. 15 includes, as reinforcement, the first connection body 11*d* formed by an insulating member such as a dielectric, and the second connection body 12*d* formed by an insulating member such as a dielectric. More specifically, at least a portion of the first connection body 11*d* and a portion of the second connection body 12*d* that contact the main columnar conductor 15 are formed by an insulating member.

In FIGS. 14, 15, 16A and 16B, the main columnar conductor 15 is arranged between (intermediate position) the second columnar sub-conductor 3 (second columnar sub-body 3*d*) and the first columnar sub-conductor 2 (first columnar sub-body 2*d*). That is, the main columnar conductor 15 is disposed at the intermediate position between the first columnar sub-conductor 2 (first columnar sub-body 2*d*) and the second columnar sub-conductor 3 (first columnar sub-body 3*d*). The U-shaped conductor 7 is bent in the U-shape. One end of the U-shaped conductor 7 faces the tip portion of the first columnar sub-conductor 2 (first columnar sub-body 2*d*), while the other end of the U-shaped conductor 7 faces the tip portion of the second columnar sub-conductor 3 (second columnar sub-body 3*d*). The central portion 7*c* of the U-shaped conductor 7 is fastened to the tip portion of the main columnar conductor 15. More specifically, the main columnar conductor 15 fixes the vicinity of the center of the central portion 7*c*, and a structure of the U-shaped conductor 7 is line-symmetric with respect to a perpendicular line passing through the vicinity of the center. In the figures, the same reference numeral indicates the same or equivalent part, and duplicated detailed explanation thereof is omitted.

In FIGS. 14, 15, 16A and 16B, the main columnar conductor 15 includes the first plate-like conductor (upper flange) 4*a* formed at the tip portion, and the second plate-like conductor 4*b* (attachment fitting) disposed on the first plate-like conductor 4*a*. In addition, the main columnar conductor 15 holds the central portion 7*c* of the U-shaped conductor 7 between the first plate-like conductor 4*a* and the second plate-like conductor 4*b*, thereby holding the U-shaped conductor. Like the first embodiment, the second plate-like conductor 4*b* is a conductor different from the main columnar conductor 15. However, after the U-shaped conductor 7 is fixed, the second plate-like conductor 4*b* becomes a part of the main columnar conductor 15. In addition, at least either the first plate-like conductor 4*a* or the second plate-like conductor 4*b* may be formed with a groove into which the U-shaped conductor 7 is fitted. According to the present application, the second plate-like conductor 4*b* is formed with a groove into which the U-shaped conductor 7 is fitted. Needless to say, the second plate-like conductor 4*b* may be omitted, and the main columnar conductor 15 may include the first plate-like conductor 4*a* (upper flange 4*a*) only. In this configuration, when the first plate-like conductor 4*a* (upper flange 4*a*) is formed with a groove into which the U-shaped conductor 7 is fitted, the U-shaped conductor 7 can be held by the main columnar conductor 15 easily. The U-shaped conductor 7 includes a first straight part that extends linearly from the one end to the first bent portion 7*a*, a second straight part that extends linearly from the other end to the second bent portion 7*b*, and the central portion 7*c* that extends linearly from the first bent portion 7*a* to the second bent portion 7*b*. In the figures, the same reference numeral indicates the same or equivalent part, and duplicated detailed explanation thereof is omitted.

In FIGS. 14, 15, 16A and FIG. 16B, the grounding conductor plate 16 (grounding metal plate 16) is a plate of a conductive material formed on the installation surface g. The grounding conductor plate 16 is disposed below the respective base-end portions of the first columnar sub-conductor 2 (first columnar sub-body 2*d*), the second columnar sub-conductor 3 (second columnar sub-body 3*d*), and the main columnar conductor 15 in an electrically insulating manner. The power feeding portion 6 is connected electrically with the grounding conductor plate 16 and the main columnar conductor 15. The main columnar conductor 15 is disposed linearly so as to face the grounding conductor plate 16 via the lower center dielectric spacer 8. The power feeding portion (power feeding point) 6 is built in the base-end portion of the main columnar conductor 15, and is connected electrically with the main columnar conductor 15 and the grounding conductor plate 16. The lower center dielectric spacer 8 is mounted on the grounding conductor plate 16 formed on the installation surface g. The first lower dielectric spacer 9 and the second lower dielectric spacer 10 are each mounted on the grounding conductor plate 16 formed on the installation surface g. The lower center dielectric spacer 8 is disposed between (intermediate position) the first lower dielectric spacer 9 and the second lower dielectric spacer 10. The first lower dielectric spacer 9, the second lower dielectric spacer 10, and the lower center dielectric spacer 8 may be an integral dielectric spacer. The first connection body 11*d* fastens the first columnar sub-conductor 2 (first columnar sub-body 2*d*) with the main columnar conductor 15. The second connection body 12*d* fastens the second columnar sub-conductor 3 (second columnar sub-body 3*d*) with the main columnar conductor 15. The first connection body 11*d* and the second connection body 12*d* have the same length. A first lower conductor spacer 9*m* and a second lower conductor spacer 10*m* are such spacers that the first lower dielectric spacer 9 and the second lower dielectric spacer 10 are replaced with conductors such as metal. In the figures, the same reference numeral indicates the same or equivalent part, and duplicated detailed explanation thereof is omitted.

Structure of the antenna device according to the second embodiment is explained below. The antenna device of the second embodiment is a monopole antenna. As illustrated in FIGS. 14 and 15, the one antenna element (exciter part (metal part)) of the monopole antenna that is the antenna device of the second embodiment includes the grounding conductor plate 16 (lower-side antenna element, other side antenna element). The other antenna element (exciter part (metal part)) of the monopole antenna that is the antenna device of the second embodiment includes the two columnar conductors (upper-side antenna element, other side antenna element). The first columnar conductor is the main columnar conductor 15, which has the base-end portion fastened to the lower center dielectric spacer 8 mounted on the grounding conductor plate 16 formed on the installation surface g, and which stands upright. The second columnar conductor is the U-shaped columnar conductor 7 that is bent in the U-shape, and that has one end fastened to the first upper dielectric spacer 13, the other end fastened to the second upper dielectric spacer 14, and the central portion 7*c* fastened to the tip portion of the main columnar conductor 15.

In addition, according to the present application, the main columnar conductor 15 includes two members that are an upper-side main columnar conductor 15*u* formed with the first plate-like conductor 4*a*, and a lower-side main columnar conductor 15*d* in which the power feeding portion 6 is built. For example, an external conductor of a coaxial line disposed at the power feeding portion 6 is connected electrically with the grounding conductor plate 16, and a central conductor of the coaxial line disposed at the power feeding portion 6 is connected electrically with the main columnar conductor 15.

According to the present application, an antenna device is disclosed that has the power feeding portion 6 built in the lower-side main columnar conductor 15*d* of the main columnar conductor 15. Hence, components are disposed (fastened), in order from the lower center dielectric spacer 8, as the lower-side main columnar conductor 15 and the upper-side main columnar conductor 15*u*. Needless to say, the power feeding portion 6 can be installed outside the main columnar conductor 15, and wiring (for example, a coaxial line) may be used between the power feeding portion 6 and the main columnar conductor 15. The first columnar sub-conductor 2, the second columnar sub-conductor 3, the main columnar conductor 15 and the U-shaped conductor 7 can be made lightweight by using hollow conductor bar (metal bar, metal pipe). Likewise, the first columnar sub-body 2*d* and the second columnar sub-body 3*d* can be made lightweight by using hollow bar. The main columnar conductor 15 and the U-shaped conductor 7 are hollow metal bars, and constitute the exciter of the monopole antenna.

In addition, unlike the first columnar sub-conductor 2 (first columnar sub-body 2*d*), the second columnar sub-conductor 3 (second columnar sub-body 3*d*) and the main columnar conductor 15, which contribute to the self-support of the antenna device of the second embodiment or the self-support by the aid of a guy wire, the U-shaped conductor 7 is supported by the main columnar conductor 15. Hence, as in the first embodiment, the U-shaped conductor 7 can have a smaller diameter than those of the first columnar sub-conductor 2 (first columnar sub-body 2*d*), the second columnar sub-conductor 3 (second columnar sub-body 3*d*), and the main columnar conductor 15. In addition, the U-shaped conductor 7 can be lightweight and can have a small diameter. Respective portions of the U-shaped conductor 7 closer to respective tips than the first bent portion 7*a* and second bent portion 7*b* (portions directed toward the installation surface g) of the U-shaped conductor 7 are also supported by the first columnar sub-conductor 2 (first columnar sub-body 2*d*) and the second columnar sub-conductor 3 (second columnar sub-body 3*d*), respectively, through the first upper dielectric spacer 13, and the second upper dielectric spacer 14.

Likewise, the first connection body 11*d* and the second connection body 12*d* illustrated in FIG. 15 can have a smaller diameter than those of the first columnar sub-conductor 2 (first columnar sub-body 2*d*), the second columnar sub-conductor 3 (second columnar sub-body 3*d*) and the main columnar conductor 15. In this point, the first and second connection bodies are different from the first columnar sub-conductor 2 (first columnar sub-body 2*d*), the second columnar sub-conductor 3 (second columnar sub-body 3*d*) and the main columnar conductor 15, which contribute to the self-support of the antenna device of the second embodiment or the self-support with the aid of a guy wire. In addition, the first connection body 11*d* and the second connection body 12*d* each can have a small diameter and can be lightweight. The first connection body 11*d* and the second connection body 12*d* each can be hollow. When, however, the first connection body 11*d* and the second connection body 12*d* are used in order to maintain the distance relationship (positional relationship) between the first columnar sub-conductor 2 (first columnar sub-body 2*d*), the second columnar sub-conductor 3 (second columnar sub-body 3*d*) and the main columnar conductor 15, the first connection body 11*d* and the second connection body 12*d* are required to have a certain degree of strength.

The structure of the antenna device of the second embodiment is explained below in more detail. As illustrated in FIGS. 14 and 15, the upper-side main columnar conductor 15*u* has a lower flange formed at the base-end portion, and has the upper flange 4*a* formed at the tip portion. The lower-side main columnar conductor 15*d* has a lower flange formed at the base-end portion, and has an upper flange formed at the tip portion. As illustrated in FIGS. 14 and 15, in the main columnar conductor 15, the lower flange of the upper-side main columnar conductor 15*u* and the upper flange of the lower-side main columnar conductor 15*d* are fastened directly by fasteners such as bolts. The upper flange 4*a* of the upper-side main columnar conductor 15*u* and the U-shaped conductor 7 are connected by the attachment fitting 4*b*. The lower center dielectric spacer 8, to which the lower flange of the lower-side main columnar conductor 15*d* is fixed, does not establish electrical conduction between the lower flange of the lower-side main columnar conductor 15*d* (main columnar conductor 15) and the grounding conductor plate 16. The lower flange of the lower-side main columnar conductor 15*d* is fastened to the facing surface of the lower center dielectric spacer 8 by fasteners such as bolts.

As illustrated in FIG. 15, the first connection body 11*d* is formed between the lower flange of the main columnar conductor 15 and that of the first columnar sub-conductor 2 (first columnar sub-body 2*d*). The first connection body 11*d* is fastened to the lower flange of the main columnar conductor 15 and that of the first columnar sub-conductor 2 (first columnar sub-body 2*d*) by fasteners such as bolts. The second connection body 12*d* is formed between the lower flange of the main columnar conductor 15 and that of the second columnar sub-conductor 3 (second columnar sub-body 3*d*). The second connection body 12*d* is fastened to the lower flange of the main columnar conductor 15 and that of the second columnar sub-conductor 3 (second columnar sub-body 3*d*) by fasteners such as bolts.

By adopting such a structure, the antenna device of the second embodiment can be realized as a low profile antenna device with a simple structure like the antenna device of the first embodiment easily. In addition, an antenna device that can stand upright on the installation surface g with a small number of guy wires, or an antenna device that can attain self-support without the aid of a guy wire can be realized easily. In particular, according to the structure illustrated in FIG. 15, the first connection body 11*d* and the second connection body 12*d* contribute to the ensuring of strength.

Next, operation of the antenna device according to the second embodiment, and the downsizing thereof are explained below with reference to FIG. 16A. FIG. 16A corresponds to the front view (FIGS. 14 and 15) of the antenna device of the second embodiment, and is a diagram schematically illustrating the exciter part (metal part, antenna element) and the power feeding point 6. According to the monopole antenna, the conductor (corresponding to upper-side antenna element and other side antenna element explained above) of a quarter wavelength is erected upright on the ground, and a voltage is supplied between such a conductor and a ground surface in such a way that power is supplied so as to produce a potential difference between both ends of the power feeding point 6 of the antenna device with respect to the mirror image of the conductor (corresponding to upper-side antenna element and other side antenna element explained above). Accordingly, the monopole antenna becomes equivalent to the dipole antenna. Hence, by bending the exciter part (corresponding to upper-side antenna element and other side antenna element explained above), current path length can be ensured and gain reduction of the antenna can be suppressed, and the device can be downsized at the same time.

According to the structure of the antenna device of the second embodiment, a high-gain and compact antenna device that has the vertical direction as a main polarization direction can be obtained. According to the structure of the antenna device of the second embodiment, a monopole antenna can be obtained that maintains the gain of the main polarized wave of the monopole antenna, and that suppresses gain of the cross polarized wave by a bilaterally symmetrical structure.

Next, an installation method (assembling procedure) of the antenna device of the second embodiment is explained below. Unlike the first embodiment, the installation method of the antenna device of the second embodiment illustrated in FIG. 15 includes the lower-side-columnar-conductor reinforcing (lower-side-columnar-body reinforcing) process, but includes no lower-side-columnar-conductor electrical connecting process. The installation method of the antenna device illustrated in FIG. 14 does not include both processes. The lower-dielectric-spacer (lower-conductor-spacer) mounting process in installation method of the antenna device of the second embodiment is a process of mounting the first lower dielectric spacer 9 (first lower conductor spacer 9*m*), the second lower dielectric spacer 10 (second lower conductor spacer 10*m*) and the lower center dielectric spacer 8 on the grounding conductor plate 16 formed on the installation surface g. The lower-dielectric-spacer (lower-conductor-spacer) mounting process can be understood as a lower-spacer mounting process. At the time of the lower-spacer mounting process, the first lower dielectric spacer 9 (first lower conductor spacer 9*m*), the second lower dielectric spacer 10 (second lower conductor spacer 10*m*), and the lower center dielectric spacer 8 can be fastened to the grounding conductor plate 16 formed on the installation surface g. However, when the first columnar sub-conductor 2 (first columnar sub-body 2*d*), the second columnar sub-conductor 3 (second columnar sub-body 3*d*) and the main columnar conductor 15 are installed, those first columnar sub-conductor 2 (first columnar sub-body 2*d*), second columnar sub-conductor 3 (second columnar sub-body 3*d*) and main columnar conductor 15 may be fastened collectively to the conductor ground plate 16. When the first lower dielectric spacer 9 (first lower conductor spacer 9*m*), the second lower dielectric spacer 10 (second lower conductor spacer 10*m*) and the lower center dielectric spacer 8 are disposed on (fastened to) the grounding conductor plate 16 formed on the installation surface g before the installation of the antenna device, the lower-spacer mounting process becomes unnecessary. When a grounding conductor plate mounting process of mounting (fastening) the grounding conductor plate 16 on the installation surface g is performed, the grounding conductor plate mounting process is required to be carried out prior to the lower-spacer mounting process.

The lower-side-columnar-conductor (lower-side-columnar-body) installing process in the installation method of the antenna device of the second embodiment is a process of setting up the first columnar sub-conductor 2 (first columnar sub-body 2*d*), the second columnar sub-conductor 3 (second columnar sub-body 3*d*) and the main columnar conductor 15 on the installation surface g. In addition, in the lower-side-columnar-conductor (lower-side-columnar-body) installing process, the main columnar conductor 15 is disposed between the first columnar sub-conductor 2 (first columnar sub-body 2*d*) and the second columnar sub-conductor 3 (second columnar sub-body 3*d*). When the lower-spacer mounting process is carried out, the lower-dielectric-spacer (lower-conductor-spacer) mounting process of mounting the first lower dielectric spacer 9 (first lower dielectric spacer 9*m*), the second lower dielectric spacer 10 (second lower dielectric spacer 10*m*) and the lower center dielectric spacer 8 on the installation surface g are required to be performed prior to the lower-side-columnar-conductor (lower-side-columnar-body) installing process. In the lower-side-columnar-conductor (lower-side-columnar-body) installing process, the base-end portions of the first columnar sub-conductor 2 (first columnar sub-body 2*d*), second columnar sub-conductor 3 (second columnar sub-body 3*d*) and the main columnar conductor 15 are fastened to the first lower dielectric spacer 9 (first lower conductor spacer 9*m*), the second lower dielectric spacer 10 (second lower conductor spacer 10*m*) and the lower center dielectric spacer 8, respectively, mounted on the installation surface g.

The lower-side-columnar-conductor reinforcing (lower-side-columnar-body reinforcing) process of the installation method of the antenna device of the second embodiment is unnecessary when the first connection body 11*d* and the second connection body 12*d*, both illustrated in FIG. 14, are not utilized. However, the antenna device illustrated in FIG. 15 requires such the process. The lower-side-columnar-conductor reinforcing (lower-side-columnar-body reinforcing) process is a process of fastening the first columnar sub-conductor 2 (first columnar sub-body 2*d*) and the second columnar sub-conductor 3 (second columnar sub-body 3*d*) to the main columnar conductor 15. More specifically, this process includes a step of connecting the main columnar conductor 15 with the first columnar sub-conductor 2 (first columnar sub-body 2*d*) with the first connection body 11*d*, and a step of connecting the main columnar conductor 15 with the second columnar sub-conductor 3 (second columnar sub-body 3*d*) with the second connection body 12*d*. The steps of the lower-side-columnar-conductor reinforcing (lower-side-columnar-body reinforcing) process can be carried out in any order. The lower-side-columnar-conductor reinforcing (lower-side-columnar-body reinforcing) process can be carried out after a U-shaped-conductor fastening process and a wiring process, which are described later.

In the U-shaped-conductor fastening process of the installation method of the antenna device of the second embodiment, one end of the U-shaped conductor 7 bent in the U-shape is fastened to a surface of the first upper dielectric spacer 13 opposite to the surface mounted on the tip portion of the first columnar sub-conductor 2 (first columnar sub-body 2*d*). Next, in this process, the other end of the U-shaped conductor 7 is fastened to a surface of the second upper dielectric spacer 14 opposite to the surface mounted on the tip portion of the second columnar sub-conductor 3 (second columnar sub-body 3*d*). Still further, in this process, the central portion 7*c* of the U-shaped conductor 7 is fastened to the tip portion of the second main columnar conductor 4. In the U-shaped-conductor fastening process, one end of the U-shaped conductor 7 is fitted in and fastened to the hole of the first upper dielectric spacer 13, while the other end of the U-shaped conductor 7 is fitted in and fastened to the hole of the second upper dielectric spacer 14.

When, in the U-shaped-conductor fastening process, the respective holes of the first upper dielectric spacer 13 and the second upper dielectric spacer 14 are utilized as in the first embodiment, the work can be facilitated when one end of the U-shaped conductor 7 and the other end thereof are fastened prior to the fastening of the central portion 7*c* of the U-shaped conductor 7. FIG. 16B illustrates, like FIG. 12A, the first columnar sub-conductor 2 (first columnar sub-body 2*d*), the second columnar sub-conductor 3 (second columnar sub-body 3*d*) and the U-shaped conductor 7 as each being hollow. Likewise, in FIG. 16B, holes into which the respective fasteners 34 are fitted are formed (opened) in the tilted surfaces of conical shapes of the first upper dielectric spacer 13 and the second upper dielectric spacer 14. As long as the strength can be secured, no particular limitation is placed on the material of the fastener 34. For example, the one end of the U-shaped conductor 7 and the other end thereof can be fitted in the respective holes of the first upper dielectric spacer 13 and the second upper dielectric spacer 14 with the central portion 7*c* of the U-shaped conductor 7 pushed against the tip portion (upper flange 4*a*) of the main columnar conductor 15, and then fastened by the respective fasteners 34. Alternatively, the one end of the U-shaped conductor 7 and the other end thereof can be fitted in the respective holes of the first upper dielectric spacer 13 and the second upper dielectric spacer 14 with the central portion 7*c* of the U-shaped conductor 7 being engaged by the tip portion (upper flange 4*a*) of the main columnar conductor 15. At this time, when the groove described above is formed in the upper flange 4*a* (first plate-like conductor 4*a*) of the main columnar conductor 15, the U-shaped conductor 7 is easy to be pushed or engaged by the upper flange 4*a* (first plate-like conductor 4*a*). As in the first embodiment, prior to the U-shaped-conductor fastening process, the upper-dielectric-spacer mounting process (a mounting process of the upper dielectric spacer for the columnar sub-conductor) is carried out. As explained previously, the first upper dielectric spacer 13 and the second upper dielectric spacer 14 have a conical shape, and the method of fastening these components is explained above.

In the second embodiment, the wiring process is carried out after the lower-side-columnar-conductor installing process (mostly, after the U-shaped-conductor fastening process). In the configuration arranging the power feeding portion 6 as illustrated in FIGS. 14 and 15, that is, when the power feeding portion 6 is disposed inside the hollow main columnar conductor 15, the power feeding portion 6 is connected electrically to the grounding conductor plate 16 by wiring through the hollow lower center dielectric spacer 5. When a coaxial line is used for connection with the grounding conductor plate 16, the central conductor of the coaxial line is wired through the interior of the lower center dielectric spacer 5.

Hence, according to the installation method of the antenna device according to the second embodiment, a high-gain and compact antenna device can be obtained for which the main polarization direction is the vertical direction. In addition, a monopole antenna can be obtained that maintains the gain of the main polarized wave of the monopole antenna, and that suppresses gain of the cross polarized wave by a bilaterally symmetrical structure. Still further, the monopole antenna can be obtained that facilitates the delivery, assembly, and installation, that has requires few number of support members such as guy wires, or that accomplish self-support without a support member.

In the antenna device (and the installation method thereof) of the second embodiment, the first columnar sub-conductor 2 and the second columnar sub-conductor 3 can each be grounded, that is, can be connected electrically with the grounding conductor plate 16 to cause the first columnar sub-conductor 2 and the second columnar sub-conductor 3 to function as the sleeve conductors of the monopole antenna. These conductors can function as the sleeve conductors because the first columnar sub-conductor 2 and the second columnar sub-conductor 3 are insulated electrically from the U-shaped conductor 7 by the first upper dielectric spacer 13 and the second upper dielectric spacer 14, respectively. In this case, according to the installation method of the antenna device of the second embodiment, in addition to the lower-side-columnar-conductor reinforcing process (when required), a lower-side-columnar-conductor grounding process is carried out.

A configuration is explained below in which the first lower conductor spacer 9*m* and the second lower conductor spacer 10*m* are used instead of the first lower dielectric spacer 9 and the second lower dielectric spacer 10. In this case, in the lower-side-columnar-conductor grounding process, the first columnar sub-conductor 2 and the second columnar sub-conductor 3 are connected electrically with the grounding conductor plate 16 and are grounded at the time of the lower-side-columnar-conductor installing process. Hence, the lower-side-columnar-conductor ground process can be finished upon the completion of the lower-side-columnar-conductor installing process. Accordingly, in this case, the lower-side-columnar-conductor installing process can be understood to include the entire lower-side-columnar-conductor grounding process. Needless to say, the first columnar sub-conductor 2 and the first lower conductor spacer 9*m* may be formed integrally. The second columnar sub-conductor 3 and the second lower conductor spacer 10*m* can also be formed integrally. In this case, for the first columnar sub-conductor 2 and the second columnar sub-conductor 3, the lower-dielectric-spacer (lower-conductor-spacer) mounting process, the lower-side-columnar-conductor installing process, and the lower-side-columnar-conductor grounding process can be recognized as being carried out in a single process.

When the first lower dielectric spacer 9 and the second lower dielectric spacer 10 are used, the lower-side-columnar-conductor grounding process in the installation method of the antenna device of the second embodiment includes a step of connecting electrically the first columnar sub-conductor 2 with the grounding conductor plate 16, and a step of connecting electrically the second columnar sub-conductor 3 with the grounding conductor plate 16. According to such an antenna device, (and the installation method thereof), the first lower dielectric spacer 9 and the second lower dielectric spacer 10 become unnecessary. However, using the hollow first lower dielectric spacer 9 and the hollow second lower dielectric spacer 10, wiring can be disposed in the respective interiors of the first lower dielectric spacer 9 and the second lower dielectric spacer 10, and grounding can be established through such wiring. According to the antenna device of the second embodiment, in the main columnar conductor 15 arranged between (intermediate position) the first columnar sub-conductor 2 and the second columnar sub-conductor 3, the first columnar sub-conductor 2 and the second columnar sub-conductor 3 can function as the sleeve conductors. Hence, the antenna device can be made wideband.

The installation method of the antenna device of the second embodiment includes three processes. The first process is the lower-side-columnar-conductor installing process. In this process, the base-end portions of the first columnar sub-conductor 2, second columnar sub-conductor 3, and main columnar conductor 15 are fastened to the first lower dielectric spacer 9, the second lower dielectric spacer 10, and the lower center dielectric spacer 8, respectively, mounted on the grounding conductor plate 16 formed on the installation surface g. In addition, in this process, the first columnar sub-conductor 2, the second columnar sub-conductor 3, and the main columnar conductor 15 are set up on the grounding conductor plate 16 respectively, and the main columnar conductor 15 is disposed between the first columnar sub-conductor 2 and the second columnar sub-conductor 3. The second process is the upper-dielectric-spacer mounting process. In this process, the first upper dielectric spacer 13 is mounted on the tip portion of the first columnar sub-conductor 2, and the second upper dielectric spacer 14 is mounted on the tip portion of the second columnar sub-conductor 3. The third process is the U-shaped conductor fastening process. In this process, one end of the U-shaped conductor 7 bent in the U-shape is fastened to a surface of the first upper dielectric spacer 13 opposite to the surface mounted on the tip portion of the first columnar sub-conductor 2. Next, in this process, the other end of the U-shaped conductor 7 is fastened to a surface of the second upper dielectric spacer 14 opposite to the surface mounted on the tip portion of the second columnar sub-conductor 3. Still further, in this process, the center portion of the U-shaped conductor 7 is fastened to the tip portion of the main columnar conductor 15.

The antenna device of the second embodiment includes the first columnar sub-conductor 2, the second columnar sub-conductor 3 arranged in parallel with the first columnar sub-conductor 2 and the main columnar conductor 15 arranged between the first columnar sub-conductor 2 and the second columnar sub-conductor 3. This antenna device further includes the grounding conductor plate 16 that is disposed below the respective base-end portions of the first columnar sub-conductor 2, second columnar sub-conductor 3, and main columnar conductor 15 in an insulated electrically manner. This antenna device also includes the power feeding portion 6 that is connected electrically with the main columnar conductor 15 and the grounding conductor plate 16. This antenna device further includes the U-shaped conductor 7 that is bent in the U-shape, has the one end facing the tip portion of the first columnar sub-conductor 2, has the other end facing the tip portion of the second columnar sub-conductor 3, and has the center part fastened to the tip portion of the main columnar conductor 15.

According to the antenna device (and the installation method thereof) of the second embodiment, when the first columnar sub-conductor 2 and the second columnar sub-conductor 3 are utilized as the sleeve conductors, the lower-side-columnar-conductor reinforcing process can be carried out. That is, with the first connection body 11*d* and the second connection body 12*d* being insulated electrically from the first columnar sub-conductor 2 and the second columnar sub-conductor 3, the main columnar conductor 15, the first columnar sub-conductor 2 and the second columnar sub-conductor 3 can be fastened. In addition, according to the antenna device (and the installation method thereof) of the second embodiment, when the first columnar sub-body 2*d* and the second columnar sub-body 3*d* are used, the first upper dielectric spacer 13 and the second upper dielectric spacer 14 can be a first upper conductor spacer with conductivity such as a metal and a second upper conductor spacer with conductivity such as a metal. The first upper conductor spacer is the first upper dielectric spacer 13 replaced by a conductor such as a metal. The second upper conductor spacer is the second upper dielectric spacer 14 replaced by a conductor such as a metal. In addition, an example case is described below in which, using the first lower dielectric spacer 9, the first columnar sub-conductor 2 is not connected electrically with (is insulated from) the grounding conductor plate 16, and using the second lower dielectric spacer 10, the second columnar sub-conductor 3 is not connected electrically with (is insulated from) the grounding conductor plate 16. Also in this case, the first upper dielectric spacer 13 and the second upper dielectric spacer 14 can be a conductive first upper conductor spacer such as a metal and a conductive second upper conductor spacer such as a metal.

That is, when the structure that supports one end of the U-shaped conductor 7 is configured, in order from the grounding conductor plate 16 side, as the conductive or insulating first lower spacer, the conductive or insulating first columnar sub-body, and the conductive or insulating first upper spacer, then at least one of the first lower spacer, the first columnar sub-body and the first upper spacer has insulation properties. Likewise, when the structure that supports the other end of the U-shaped conductor 7 is configured as, in order from the grounding conductor plate 16 side, the conductive or insulating second lower spacer, the conductive or insulating second columnar sub-body and the conductive or insulating second upper spacer, at least one of the second lower spacer, the second columnar sub-body, and the second upper spacer has insulation properties. The first lower spacer, the first columnar sub-body, and the first upper spacer can be referred to as a first support body. The second lower spacer, the second columnar sub-body, and the second upper spacer can be referred to as a second support body. The first support body and the second support body support the U-shaped conductor 7, and these bodies each have a substantially columnar external shape. In this case, the base-end portion of the first support body is fastened on the grounding conductor plate 16 (installed on the installation surface g), and the tip portion is fastened to one end of the U-shaped conductor 7. Likewise, the base-end portion of the second support body is fastened on the grounding conductor plate 16 (installed on the installation surface g), and the tip portion is fastened to the other end of the U-shaped conductor 7. The U-shaped conductor 7 is insulated electrically from the grounding conductor plate 16 by the first support body and the second support body. Like the first upper spacer (first dielectric spacer 13 and first conductor spacer) and the second upper spacer (second dielectric spacer 14 and second conductor spacer), the first support body and the second support body are each formed with a hole at the tip portion into which the U-shaped conductor 7 is fitted, and also a hole into which the fastener 34 is fitted to fasten the U-shaped conductor 7 fitted in the foregoing hole.

When such first support body and second support body are caused to function as the sleeve conductors, the base-end side of the first support body and that of the second support body can be formed by a conductor, and can be connected electrically with the grounding conductor plate 16, and the tip side can be formed by an insulating member such as a dielectric. In this configuration, like the first upper dielectric spacer 13 and the second upper dielectric spacer 14, the tip side may be formed with a hole (groove) into which the U-shaped conductor 7 is fitted. In addition, like the first upper dielectric spacer 13 and the second upper dielectric spacer 14, the tip side may be formed with a hole into which the fastener 34 is fitted.

Hence, the installation method of the antenna device of the second embodiment includes the two processes. The first process is a lower-side-columnar-body installing process. In this process, the base-end portion of the main columnar conductor 15 is fastened to the first support body; the second support body, the lower center dielectric spacer 8 and the lower center dielectric spacer 8 are mounted on the grounding conductor plane 16 formed on the installation surface g; and the first support body, the second support body, and the main columnar conductor 15 are set up individually on the grounding conductor plate 16, with the main columnar conductor 15 disposed between the first support body and the second support body. The second process is the U-shaped conductor fastening process. In this process, the one end of the U-shaped conductor 7 bent in the U-shape is fastened to a side of the first support body opposite to the grounding conductor plate-16 side. Further, in this process, the other end of the U-shaped conductor 7 is fastened to a side of the second support body opposite to the grounding conductor plate-16 side. Still further, in this process, the center portion of the U-shaped conductor 7 is fastened to the tip portion of the main columnar conductor 15.

Hence, the antenna device of the second embodiment includes the first support body, the second support body arranged in parallel with the first support body, and the main columnar conductor 15 arranged between the first support body and the second support body. This antenna device further includes the grounding conductor plate 16 that is disposed below the respective base-end portions of the first support body, the second support body, and the main columnar conductor 15 in a manner so as to be insulated electrically from the main columnar conductor 15. This antenna device also includes the power feeding portion 6 that is connected electrically with the main columnar conductor 15 and the grounding conductor plate 16. This antenna device further includes the U-shaped conductor 7 that is bent in the U-shape and has one end facing the tip portion of the first support body, the other end facing the tip portion of the second support body and the center part fastened to the tip portion of the main columnar conductor 15.

Application of the second embodiment to another embodiment is described. First, ability to apply the first support body and the second body to the antenna device (dipole antenna) of the first embodiment is explained. That is, a structure can be employed in which, without installing the grounding conductor plate 16, the first support body and the second support body are connected electrically to the first main columnar conductor 1 through the first connection conductor 11 and the second connection conductor 12. More specifically, this antenna device includes the first support body, and the second support body arranged in parallel with the first support body. This antenna device further includes the first main columnar conductor 1 arranged between the first support body and the second support body, and connected electrically with the first support body and the second support body; and the second main columnar conductor 4 is disposed in series so as to face the first main columnar conductor 1 via the upper center dielectric spacer 5. In addition, this antenna device includes the power feeding portion 6 that is connected electrically to the first main columnar conductor 1 and the second main columnar conductor 4. Still further, this antenna device includes the U-shaped conductor 7 that is bent in the U-shape, that has one end facing (fastened to) the tip portion of the first support body, that has the other end facing (fastened to) the tip portion of the second support body, and that has the center part fastened to the tip portion of the second main columnar conductor 4. That is, this antenna device is a dipole antenna. The same is true of a third embodiment discussed below. More specifically, the first columnar sub-conductor 2, the second columnar sub-conductor 3, a third columnar sub-conductor 17 and a fourth columnar sub-conductor 18 become respective parts of the first support body, the second support body, the third support body (third lower spacer, third columnar sub-body and third upper spacer), and fourth support body (fourth lower spacer, fourth columnar sub-body and fourth upper spacer). In addition, the third columnar sub-conductor 17 and the fourth columnar sub-conductor 18 to be explained in the following third embodiment can be caused to function as sleeve conductors. That is, at least one of the first columnar sub-conductor 2, the second columnar sub-conductor 3, the third columnar sub-conductor 17 and the fourth columnar sub-conductor 18 can be a sleeve conductor.

Third Embodiment

Figure 17:
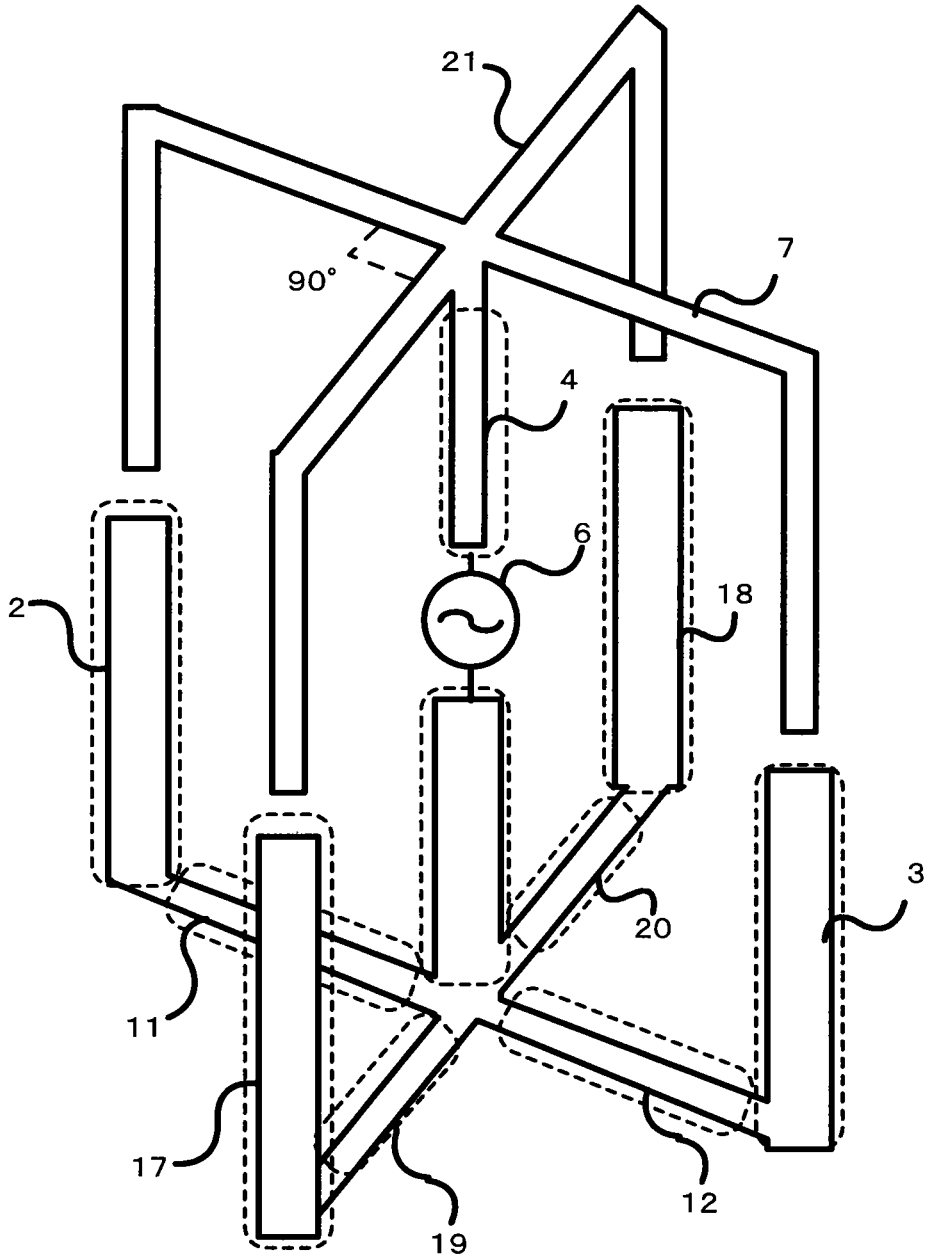
FIG. 17 is a schematic diagram illustrating a current path of an antenna device according to a third embodiment of the present disclosure.
Figure 18:
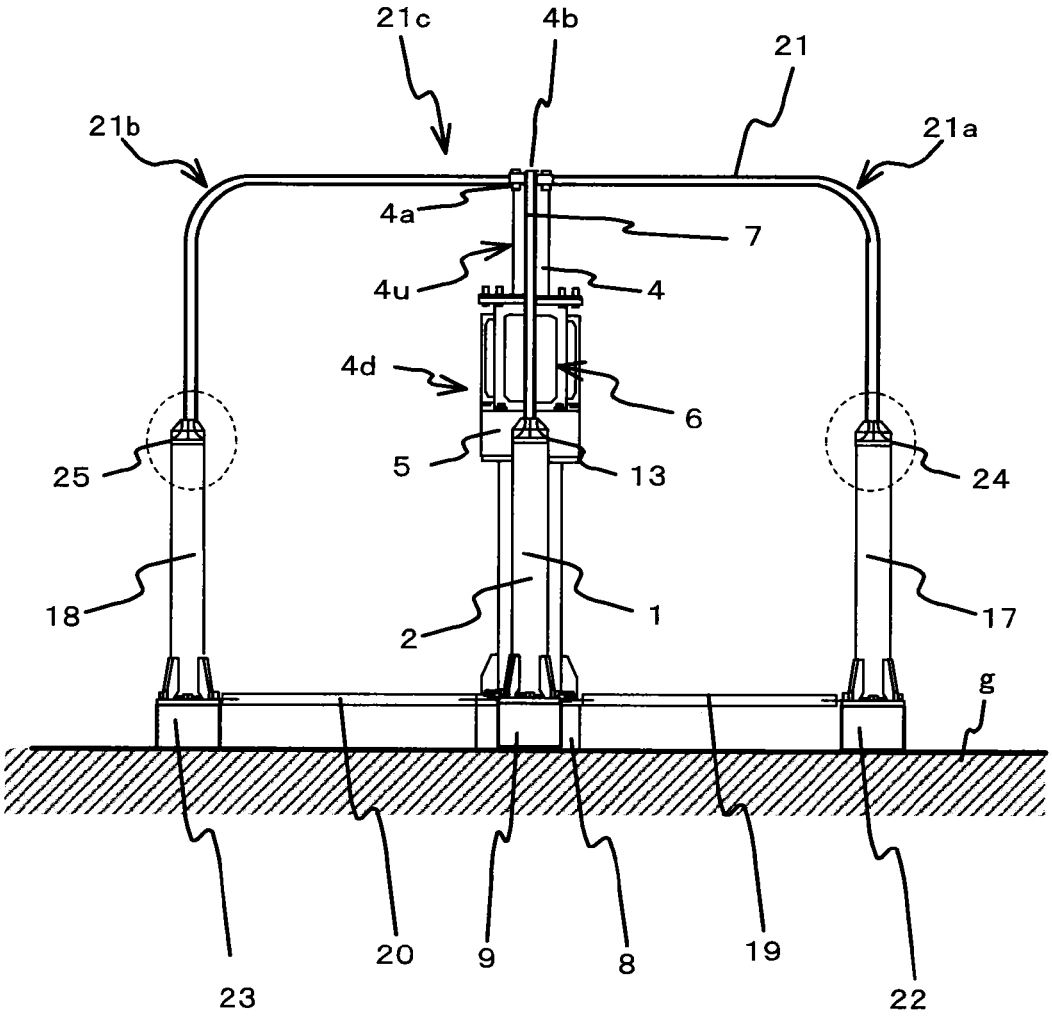
FIG. 18 is a left side view of the antenna device according to the third embodiment.
Figure 19:
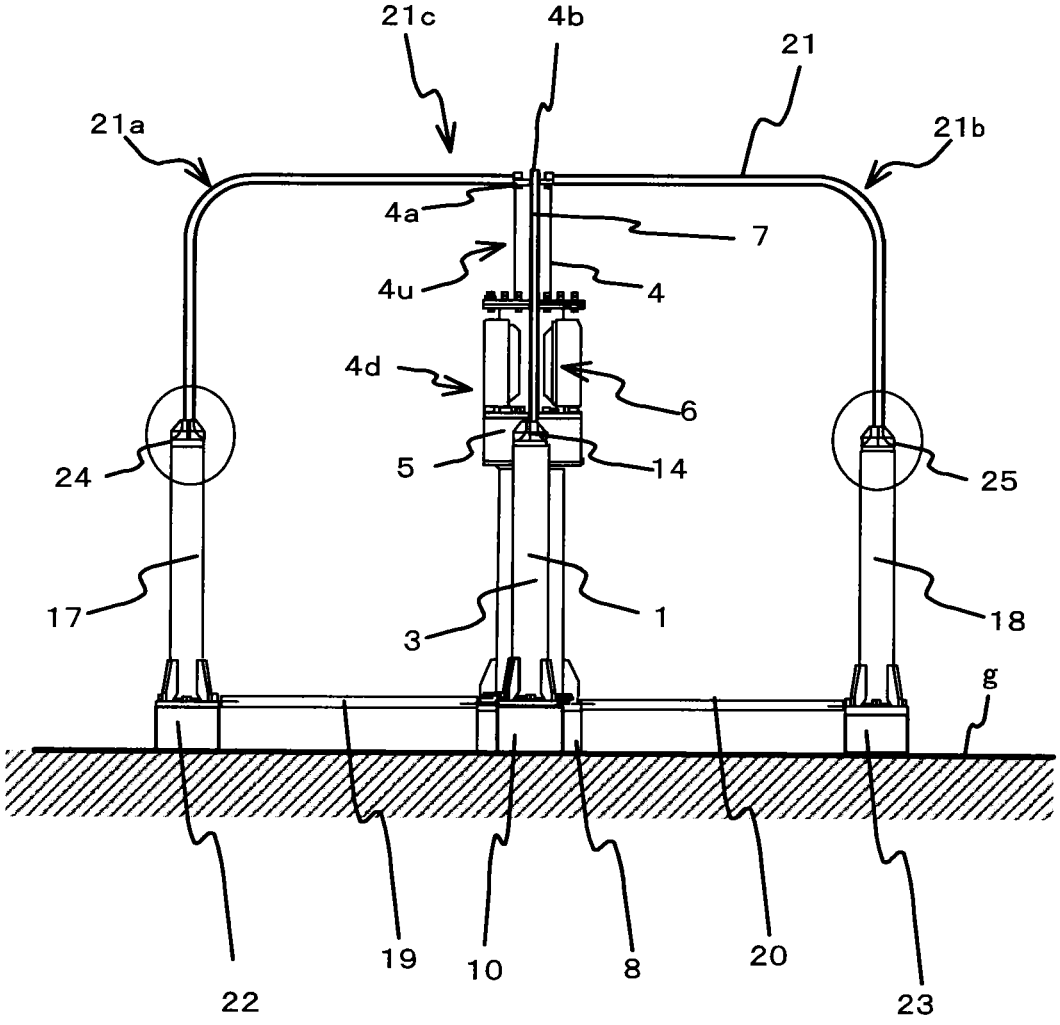
FIG. 19 is a right side view of the antenna device according to the third embodiment.

The third embodiment of the present disclosure is explained with reference to FIGS. 17-20. FIG. 17 is a diagram clarifying the correspondence relationship with the specific structural elements of an antenna device illustrated in FIG. 18 and FIG. 19. In FIG. 17, the structural elements are illustrated separately from one another by use of dashed lines. FIG. 12A is an enlarged cross-sectional view of a dashed-line portion of the antenna device in the front view of FIG. 18 for the antenna device and in the back view of FIG. 19 for the antenna device. FIG. 12A illustrates a columnar conductor and a U-shaped conductor, each divided into two pieces in the direction in which, for example, the planar view of FIG. 2 is viewed, in other words, the columnar conductor and the U-shaped conductor are each divided into two pieces in the respective directions in which the columnar conductor and the U-shaped conductor extend. According to the antenna devices (and the installation methods thereof) of the first embodiment and the second embodiment, a structure is employed in which, at bilaterally symmetrical locations with respect to the hollow metal bar (first main columnar conductor 1 and second main columnar conductor 4, and main columnar conductor 15) for power feeding, the other two hollow metal bars (first columnar sub-conductor 2 and second columnar sub-conductor 3) are installed. In contrast, according to the antenna device of the third embodiment, a structure is employed in which, on the circumference around the hollow metal bar (first main columnar conductor 1 and second main columnar conductor 4) for power feeding, multiple other hollow metal bars (third columnar sub-conductor 17 and fourth columnar sub-conductor 18) are installed at an equal angular pitch. Hence, the rigidity of the antenna device can be improved. In addition, an antenna device can be obtained that has a further reduced number of support members, or can accomplish self-support without use of a support member. Illustration of the front view (back view) and the like is omitted from illustrations of the antenna device illustrated in FIG. 18 (left side view) and FIG. 19 (right side view). Among the structural elements illustrated in FIG. 18 and FIG. 19, the similar structural element to that of the antenna device of the first embodiment has a corresponding (consistent) positional relationship with the front view of FIG. 1 (back view of FIG. 2). Note that, when viewed as a planar view, the U-shaped conductor 7 and a second U-shaped conductor 21 as a whole can be understood to constitute an X-shaped conductor formed in X-shape. A single X-shaped conductor may be used instead of the U-shaped conductor 7 and the second U-shaped conductor 21.

According to the third embodiment, an example case is described below in which the antenna device is a dipole antenna, and the above-mentioned equal angular pitch on the circumference is 90 degrees. According to this antenna device, the third columnar sub-conductor 17, a third lower dielectric spacer 22, a third upper dielectric spacer 24, the fourth columnar sub-conductor 18, a fourth lower dielectric spacer 23, a fourth upper dielectric spacer 25 and the second U-shaped conductor 21 rotated by 90 degrees around the hollow metal bar (first main columnar conductor 1 and second main columnar conductor 4), respectively, correspond to the first columnar sub-conductor 2, the first lower dielectric spacer 9, the first upper dielectric spacer 13, the second columnar sub-conductor 3, the second lower dielectric spacer 10, the second upper dielectric spacer 14, and the U-shaped conductor 7. Note that a third connection conductor 19 and a fourth connection conductor 20 rotated by 90 degrees around the hollow metal bar (first main columnar conductor 1 and second main columnar conductor 4) correspond respectively to the first connection conductor 11 and the second connection conductor 12.

The antenna device can be a monopole antenna and the above-explained equal angular pitch can be selected freely. An expected installation surface g for the antenna device of the third embodiment is a ground, the roof of a building, or the like. An example structure of the present disclosure is described in the embodiment, and the present disclosure is not limited to the examples explained in the embodiments. The description of the third embodiment explains mainly differences with respect to the first and second embodiments, and the explanation of common parts, such as the antenna structure and the dielectric spacer structure, is omitted occasionally.

According to the third embodiment, the first columnar sub-conductor 2, the first lower dielectric spacer 9, the first upper dielectric spacer 13, the second columnar sub-conductor 3, the second lower dielectric spacer 10, the second upper dielectric spacer 14 and the U-shaped conductor 7, respectively, correspond to the third columnar sub-conductor 17, the third lower dielectric spacer 22, the third upper dielectric spacer 24, the fourth columnar sub-conductor 18, the fourth lower dielectric spacer 23, the fourth upper dielectric spacer 25 and the second U-shaped conductor 21. Hence, the duplicated explanation for "the first columnar sub-conductor 2, the first lower dielectric spacer 9, the first upper dielectric spacer 13, the second columnar sub-conductor 3, the second lower dielectric spacer 10, the second upper dielectric spacer 14, and the U-shaped conductor 7" similar to the first and second embodiments is omitted.

As illustrated in FIGS. 17-20, the first main columnar conductor 1 is disposed between (intermediate position) the third columnar sub-conductor 17 and the fourth columnar sub-conductor 18 arranged in parallel with the third columnar sub-conductor 17. That is, the first main columnar conductor 1 is disposed at the intermediate position between the third columnar sub-conductor 17 and the fourth columnar sub-conductor 18. In addition, the first main columnar conductor 1 is connected electrically to the third columnar sub-conductor 17 and the fourth columnar sub-conductor 18. In the figures, the same reference numeral indicates the same or equivalent part, and duplicated detailed explanation thereof is omitted.

As illustrated in FIGS. 17-20, the second U-shaped conductor 21 is bent in a U-shape. The one end of the second U-shaped conductor 21 faces the tip portion of the third columnar sub-conductor 17. The other end of the second U-shaped conductor 21 faces the tip portion of the fourth columnar sub-conductor 18. A center portion 21*c* of the second U-shaped conductor 21 is fastened to the tip portion of the second main columnar conductor 4. Since the center periphery of the center portion 21*c* is fastened to the second main columnar conductor 4, the second U-shaped conductor 21 employs a structure that is line-symmetric with respect to a perpendicular line passing through the center periphery. The U-shaped conductor 7 and the second U-shaped conductor 21 are held by the tip portion of the second main columnar conductor 4 at the crossing part of them. When a structure is employed in which the U-shaped conductor 7 and the second U-shaped conductor 21 are each divided into two pieces at the center portion 21*c*, those conductors can be fastened by the upper flange 4*a* (first plate-like conductor 4*a*) and the attachment fitting 4*b* (second plate-like conductor 4*b*) without crossing the U-shaped conductor 7 and the second U-shaped conductor 21, and can be integrated together. The U-shaped conductor 7 and the second U-shaped conductor 21 each can be formed of a tubular conductor, and one can be fitted into the other, thereby integrating these conductors with each other. As a modified example of this structure, the second U-shaped conductor 21 is formed of a tubular conductor, and the second U-shaped conductor 21 is fitted in the upper flange 4*a* (first plate-like conductor 4*a*). That is, the second U-shaped conductor 21 may be divided into pieces that are fastened integrally at the center portion 21*c*. The term integral in this case means an electrical integration. That is, like the U-shaped conductor 7, the second U-shaped conductor 21 may be a combination of L-shaped conductors formed in an L-shape. In this case, with reference to a first bent portion 21*a* (second bent portion 21*b*), one end of both L-shaped conductor is fastened (fitted) to the third upper dielectric spacer 24 (fourth upper dielectric spacer 25). In addition, the other ends of both L-shaped conductors are fastened by the tip portion (upper flange 4*a* (first plate-like conductor 4*a*) and the attachment fitting 4*b* (second plate-like conductor 4*b*)) of the second main columnar conductor 4. Still further, the U-shaped conductor 7 and the second U-shaped conductor 21 can employ a structure in which the second U-shaped conductor can be divided at the first bent portion 21*a* and the second bent portion 21*b*. The U-shaped conductor 7 and the second U-shaped conductor 21 can be an integral conductor. In the figures, the same reference numeral indicates the same or equivalent part, and duplicated detailed explanation thereof is omitted.

As illustrated in FIGS. 17-20, the second main columnar conductor 4 holds and fastens the center part 21*c* of the second U-shaped conductor 21 between the first plate-like conductor 4*a* and the second plate-like conductor 4*b*. The second plate-like conductor 4*b* is a conductor different from the second main columnar conductor 4. However, the second plate-like conductor 4*b* becomes a part of the second main columnar conductor 4 after the second U-shaped conductor 21 is fastened. In addition, at least either the first plate-like conductor 4*a* or the second plate-like conductor 4*b* may be formed with a groove into which the second U-shaped conductor 21 is fitted. According to the present application, the second plate-like conductor 4*b* is formed with a groove into which the second U-shaped conductor 21 is fitted. The second U-shaped conductor 21 includes a first straight part that extends linearly from one end to the first bent portion 21*a*, a second straight part that extends linearly from the other end to the second bent portion 21*b*, and the center part 21*c* that extends linearly from the first bent portion 21*a* to the second bent portion 21*b*. According to the present application, the second bent portion 21*a* and the second bent portion 21*b* can include members formed by bending by 90 degrees. That is, the second U-shaped conductor 21 can be also understood as a second open-bottomed rectangle-shaped conductor 21. In the figures, the same reference numeral indicates the same or equivalent part, and duplicated detailed explanation thereof is omitted.

Figure 20:
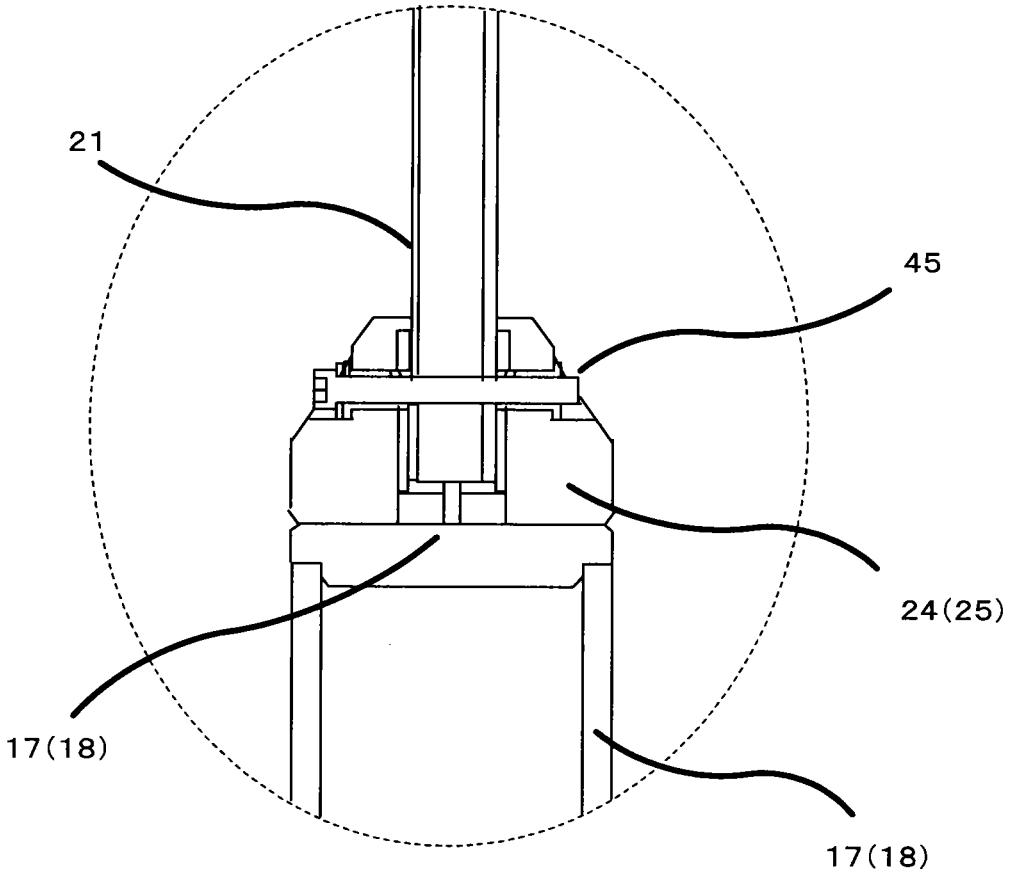
FIG. 20 is an explanatory diagram illustrating an assembling procedure of a method for installing the antenna device according to the third embodiment.

As illustrated in FIGS. 17-20, the third lower dielectric spacer 22 and the fourth lower dielectric spacer 23 are mounted on the installation surface g, respectively, and the lower center dielectric spacer 8 is disposed therebetween (intermediate position). The third lower dielectric spacer 22, the fourth lower dielectric spacer 23, and the lower center dielectric spacer 8 can be an integrated dielectric spacer. In addition, these spacers can be buried in the installation surface g, or the installation surface g itself may have the respective functions of these dielectric spacers. The third connection conductor 19 connects electrically the third columnar sub-conductor 17 with the first main columnar conductor 1. The fourth connection conductor 20 connects electrically the fourth columnar sub-conductor 18 with the first main columnar conductor 1. The third connection conductor 19 and the fourth connection conductor 20 have the same length. The third connection conductor 19 and the fourth connection conductor 20 can also serve as reinforcement that allows the first main columnar conductor 1, the third columnar sub-conductor 17 and the fourth columnar sub-conductor 18 to stand upright. The third upper dielectric spacer 24 is formed at the tip portion of the third columnar sub-conductor 17. The fourth upper dielectric spacer 25 is formed at the tip portion of the fourth columnar sub-conductor 18. The third upper dielectric spacer 24 and the fourth upper dielectric spacer 25 are each, for example, formed in a conical shape that is a shape having a tapered upper portion. As illustrated in FIG. 20, the third columnar sub-conductor 17, the fourth columnar sub-conductor 18 and the second U-shaped conductor 21 are hollow. Likewise, as illustrated in FIG. 20, holes into which the respective fasteners 45 to fasten the second U-shaped conductor 21 are fitted are formed (opened) in the tilted surface of the conically shaped third upper dielectric spacer 24 and that of the conically shaped fourth upper dielectric spacer 25. Like the fastener 34, the material of the fastener 45 is not limited to any particular material as long as strength can be secured. In the figures, the same reference numeral indicates the same or equivalent part, and duplicated detailed explanation thereof is omitted.

Next, an installation method (assembling procedure) of the antenna device according to the third embodiment is explained. In the lower-dielectric-spacer mounting process in the installation method of the antenna device of the third embodiment, the first lower dielectric spacer 9, the second lower dielectric spacer 10 and the lower center dielectric spacer 8 are mounted on the installation surface g, and the third lower dielectric spacer 22, the fourth lower dielectric spacer 23, and the lower center dielectric spacer 8 are mounted on the installation surface g. When the first lower dielectric spacer 9, the second lower dielectric spacer 10 (third lower dielectric spacer 22 and fourth lower dielectric spacer 23) and the lower center dielectric spacer 8 are disposed on (fastened to) the installation surface g before the installation of the antenna device, the lower-dielectric-spacer mounting process becomes unnecessary. The lower-dielectric-spacer mount process also becomes unnecessary when the installation surface g functions as the dielectric spacer.

In the lower-side-columnar-conductor installing process in the installation method of the antenna device of the third embodiment, the first columnar sub-conductor 2, the second columnar sub-conductor 3, the third columnar sub-conductor 17, the fourth columnar sub-conductor 18, and the first main columnar conductor 1 are set up individually on the installation surface g, and the first main columnar conductor 1 is disposed between the first columnar sub-conductor 2 and the second columnar sub-conductor 3. In addition, in this process, the first main columnar conductor 1 is disposed between the third columnar sub-conductor 17 and the fourth columnar sub-conductor 18. According to the lower-side-columnar-conductor electrical connecting process in the installation method of the antenna device of the third embodiment, the first columnar sub-conductor 2 and the second columnar sub-conductor 3 are connected electrically with the first main columnar conductor 1. In addition, in this process, the third columnar sub-conductor 17 and the fourth columnar sub-conductor 17 are connected electrically with the first main columnar conductor 1. More specifically, this process includes a step of connecting the first main columnar conductor 1 with the first columnar sub-conductor 2 through the first connection conductor 11, a step of connecting the first main columnar conductor 1 with the second columnar sub-conductor 3 through the second connection conductor 12, a step of connecting the first main columnar conductor 1 with the third columnar sub-conductor 17 through the third connection conductor 19, and a step of connecting the first main columnar conductor 1 with the fourth columnar sub-conductor 18 through the fourth connection conductor 20. The steps of the lower-side-columnar-conductor electrical connecting process can be performed in any order. The lower-side-columnar-conductor electrical connecting process may be carried out after the U-shaped-conductor fastening process and the wiring process, which are described later. In addition, the lower-side-columnar-conductor electrical connecting process can be said to provide reinforcement by the first connection conductor 11, the second connection conductor 12, the third connection conductor 19, and the fourth connection conductor 20. Hence, the lower-side-columnar-conductor electrical connecting process can be also understood as a lower-side-columnar-conductor reinforcing process. The upper-side-columnar-conductor installing process can be carried out before the lower-side-columnar-conductor installing process in the installation method of the antenna device of the third embodiment. In this case, in the lower-side-columnar-conductor installing process, the first main columnar conductor 1 that is connected with the second main columnar conductor 4 via the upper center dielectric spacer 5 is set up on the installation surface g. The wiring process is carried out after the upper-side-columnar-conductor installing process, and mostly after the U-shaped-conductor fastening process.

The U-shaped-conductor fastening process includes two processes. The first one is a first U-shaped-conductor fastening process. In this process, one end of the U-shaped conductor 7 bent in the U-shape is fastened to (fitted in) a surface of the first upper dielectric spacer 13 opposite to the surface mounted on the tip portion of the first columnar sub-conductor 2, the other end of the U-shaped conductor 7 is fastened to (fitted in) a surface of the second upper dielectric spacer 14 opposite to the surface mounted on the tip portion of the second columnar sub-conductor 3, and the center portion of the U-shaped conductor 7 is fastened to the tip portion of the second main columnar conductor 4. The second one is a second U-shaped-conductor fastening process. In this process, one end of the second U-shaped conductor 21 bent in the U-shape is fastened to (fitted in) a surface of the third upper dielectric spacer 24 opposite to the surface mounted on the tip portion of the third columnar sub-conductor 17, the other end of the second U-shaped conductor 21 is fastened to (fitted in) a surface of the fourth upper dielectric spacer 25 opposite to the surface mounted on the tip portion of the fourth columnar sub-conductor 18, and the center part of the second U-shaped conductor 21 is fastened to the tip portion of the second main columnar conductor 4. The steps of the first U-shaped-conductor fastening process and that of the second U-shaped-conductor fastening process can be carried out in any order. The fastening of the central portion 7*c* of the U-shaped conductor 7 and that of the center portion 21*c* of the second U-shaped conductor 21 may be performed simultaneously.

According to the present application, the third upper dielectric spacer 24 and the fourth upper dielectric spacer 25 are formed with respective holes. These holes can be simple recesses that allow both ends of the thin second U-shaped conductor 21 to be fitted therein. Accordingly, the third columnar sub-conductor 17 and the second U-shaped conductor 21 (one end) can be fastened by the fastener 45 without establishing electrical conduction therebetween. In addition, the fourth columnar sub-conductor 18 and the second U-shaped conductor 21 (other end) can be fastened by the fastener 45 without establishing electrical conduction therebetween. The upper-dielectric-spacer mounting process (a mounting process of the upper dielectric spacer for the columnar sub-conductor) of mounting the third upper dielectric spacer 24 on the tip portion (upper flange) of the third columnar sub-conductor 17, and the fourth upper dielectric spacer 25 on the tip portion (upper flange) of the fourth columnar sub-conductor 18 is carried out prior to the U-shaped-conductor fastening process. When the third upper dielectric spacer 17 and the fourth upper dielectric spacer 18 are conically shape as explained above, a bolt hole can be formed in the lower large-diameter, and these spacers can be fastened to the respective tip portions of the third columnar sub-conductor 17 and the fourth columnar sub-conductor 18 by fasteners such as bolts.

Hence, according to the installation method of the antenna device of the third embodiment, a high-gain and compact antenna device can be obtained that has the vertical direction as a main polarization direction. In addition, a dipole antenna can be obtained that maintains the gain of the main polarized wave of the dipole antenna, and that suppresses gain of the cross polarized wave by a bilaterally symmetrical structure. By the third columnar sub-conductor 17 and the fourth columnar sub-conductor 18, furthermore, a dipole antenna or monopole antenna can be obtained that facilitates delivery, assembly, and installation, that requires few support members such as guy wires, or can accomplish self-support without a support member.

The antenna device of the first to third embodiments include the first columnar sub-conductor 2 (first support body), and the second columnar sub-conductor 3 (second support body) arranged in parallel with the first columnar sub-conductor 2 (first support body). In addition, this antenna device includes the main columnar conductor 15 (first main columnar conductor 1) arranged between (intermediate position) the first columnar sub-conductor 2 (first support body) and the second columnar sub-conductor 3 (second support body), and fastened in a manner so as to be connected electrically to or insulated from the first columnar sub-conductor 2 (first support body) and the second columnar sub-conductor 3 (second support body). Still further, this antenna device includes the U-shaped conductor which is bent in the U-shape, has one end facing the tip of the first columnar sub-conductor 2 (first support body), has the other end facing the tip of the second columnar sub-conductor 3 (second support body), and has the center part fastened to the tip portion of the main columnar conductor 15 (second main columnar conductor 4). The main columnar conductor 15 can be arranged simply between (intermediate position) the first columnar sub-conductor 2 (first support body) and the second columnar sub-conductor 3 (second support body). That is, the main columnar conductor 15 may not be connected electrically to the first columnar sub-conductor 2 (first support body) and the second columnar sub-conductor 3 (second support body), or may not be fastened in a manner insulated electrically from the first columnar sub-conductor 2 (first support body) and the second columnar sub-conductor 3 (second support body).

The installation method of the antenna device of the first to third embodiments includes three processes. The first process is the lower-side-columnar-conductor installing process. In this process, the base-end portions of the first columnar sub-conductor 2 (first support body), the second columnar sub-conductor 3 (second support body) and the main columnar conductor 15 (first main columnar conductor 1) are fastened to the first lower dielectric spacer 9 (first support body), the second lower dielectric spacer 10 (second support body) and the lower center dielectric spacer 8, respectively, mounted on the installation surface g (grounding conductor plate 16). Next, in this process, the first columnar sub-conductor 2 (first support body), the second columnar sub-conductor 3 (second support body), and the main columnar conductor 15 (first main columnar conductor 1) are set up individually on the grounding conductor plate 16 (installed on the installation surface g). In this case, the main columnar conductor 15 (first main columnar conductor 1) is disposed between the first columnar sub-conductor 2 (first support body) and the second columnar sub-conductor 3 (second support body). The second process is the lower-side-columnar-conductor electrical connecting (lower-side-columnar-conductor reinforcing) process. This process is the lower-side-columnar-conductor installing process of connecting electrically the first columnar sub-conductor 2 and the second columnar sub-conductor 3 with the grounding conductor plate 16. In this process, the first columnar sub-conductor 2 (first support body) and the second columnar sub-conductor 3 (second support body) are fastened in a manner connected electrically with the main columnar conductor 15 (first main columnar conductor 1) or insulated electrically therefrom. The third process is the U-shaped-conductor fastening process. In this process, one end of the U-shaped conductor 7 bent in the U-shape is fastened to a surface of "the first columnar sub-conductor of the first upper dielectric spacer 13" (first support body) opposite to the surface mounted on the tip portion of the first columnar sub-conductor (first support body). Further, in this process, the other end of the U-shaped conductor 7 is fastened to a surface opposite to the surface mounted on the tip portion of "the second columnar sub-conductor 3 (second support body) of the second upper dielectric spacer 14". Still further, in this process, the center portion of the U-shaped conductor 7 is fastened to the tip portion of the main columnar conductor 15 (second main columnar conductor 4). The lower-side-columnar-conductor electrical connecting (lower-side-columnar-conductor reinforcing) process (the lower-side-columnar-conductor installing process of connecting electrically the first columnar sub-conductor 2 and the second columnar sub-conductor 3 with the grounding conductor plate 16) can be omitted.

According to the first to third embodiments, an antenna device, and installation method thereof, can be obtained that can maintain the gain of a linear (thin columnar) antenna, can be carried easily when disassembled, can be assembled and installed easily at a location to which the parts of such an antenna device are carried, and can require little installation area since the necessary number of support members such as guy wires is small or such support members are completely unnecessary. Needless to say, the antenna device and the installation method thereof, according to the first to third embodiments are applicable to both dipole antennas and monopole antennas.

In the present application, the first main columnar conductor 1, the first columnar sub-conductor 2, the second columnar sub-conductor 3, the second columnar sub-body 3*d*, the second main columnar conductor 4, the upper-side second main columnar conductor 4*u*, the lower-side second main columnar conductor 4*d*, the main columnar conductor 15, the upper-side main columnar conductor 15*u*, the lower-side main columnar conductor 15*d*, the third columnar sub-conductor 17 and the fourth columnar sub-conductor 18 can each be a hollow tubular member. Those tubular members (columnar conductors, columnar bodies) each can employ a structure completely internally communicated from the base end (first end) to the tip (other end), or may employ an internally non-communicated structure that has internode diaphragms therein like that of bamboo. The non-communicated structure can contribute to the securing of strength. Even in the communicated structure, reinforcement (structure members) may be formed therein to secure strength. In the same way, the communicated or non-communicated structure is also applicable to the U-shaped conductor 7 and the second U-shaped conductor 21. Needless to say, in the U-shaped conductor 7 and the second U-shaped conductor 21, the non-communicated structure and the communicated structure with the internal reinforcement (structure member) can contribute to the securing of strength.

This application is based on Japanese Patent Application No. 2013-043201, filed on Mar. 5, 2013. The entire specification, claims, and drawings of Japanese Patent Application No. 2013-043201 are herein incorporated in this specification by reference.

INDUSTRIAL APPLICABILITY

The present disclosure is suitable for an antenna device, such as a dipole antenna or a monopole antenna.

REFERENCE SIGNS LIST

1 First main columnar conductor
2 First columnar sub-conductor
2*d* First columnar sub-body
3 Second columnar sub-conductor
3*d* Second columnar sub-conductor
4 Second main columnar conductor
4*a* First plate-like conductor (upper flange)
4*b* Second plate-like conductor (attachment fitting)
4*u* Upper-side second main columnar conductor
4*d* Lower-side second main columnar conductor
5 Upper center dielectric spacer
6 Power feeding part (power feeding point)
7 U-shaped conductor (open-bottomed rectangle-shaped conductor)

7*a* First bent portion
7*b* Second bent portion
7*c* Center portion
8 Lower center dielectric spacer
9 First lower dielectric spacer
9*m* First lower conductor spacer
10 Second lower dielectric spacer
10*m* Second lower conductor spacer
11 First connection conductor
11*d* First connection body
12 Second connection conductor
12*d* Second connection body
13 First upper dielectric spacer
14 Second upper dielectric spacer
15 Main columnar conductor
15*u* Upper-side main columnar conductor
15*d* Lower-side main columnar conductor
16 Grounding conductor plate (grounding metal plate)
17 Third columnar sub-conductor
18 Fourth columnar sub-conductor
19 Third connection conductor
20 Fourth connection conductor
21 Second U-shaped conductor (conductor having an inverted U shape)
21*a* First bent portion
21*b* Second bent portion
21*c* Center portion
22 Third lower dielectric spacer
23 Fourth lower dielectric spacer
24 Third upper dielectric spacer
25 Fourth upper dielectric spacer
34 Fastener (for U-shaped conductor 7)
45 Fastener (for second U-shaped conductor 21)
g Installation surface
h Current path
i Current vector
j Main polarization direction

The invention claimed is:

1. A method for installing an antenna device comprising:

one dipole antenna exciter including a first columnar sub-conductor, a second columnar sub-conductor and a first main columnar conductor; and another dipole antenna exciter including a second main columnar conductor and a U-shaped conductor bent into a U-shape;

wherein the method comprises:

a lower-side-columnar-conductor installing process including:

setting up the first columnar sub-conductor on an installation surface, setting up the second columnar sub-conductor on the installation surface, and setting up the first main columnar conductor disposed between the first columnar sub-conductor and the second columnar sub-conductor on the installation surface;

a lower-side-columnar-conductor electrical connecting process of connecting electrically the first columnar sub-conductor and the second columnar sub-conductor with the first main columnar conductor;

an upper-side-columnar-conductor installing process of fastening a base end portion of the second main columnar conductor to an opposite surface of an upper center dielectric spacer, mounted on a tip portion of the first main columnar conductor, to a surface mounted on the tip portion of the first main columnar conductor, and of setting up the second main columnar conductor;

an upper-dielectric-spacer mounting process of mounting a first upper dielectric spacer on a tip portion of the first columnar sub-conductor, and mounting a second upper dielectric spacer on a tip portion of the second columnar sub-conductor;

an U-shaped-conductor fastening process in which, an one end of the U-shaped conductor bent in the U-shape is fastened to an opposite surface of the first upper dielectric spacer to a surface mounted on the tip portion of the first columnar sub-conductor, another end of the U-shaped conductor is fastened to an opposite surface of the second upper dielectric spacer to a surface mounted on the tip portion of the second columnar sub-conductor, and a center portion of the U-shaped conductor is fastened to a tip portion of the second main columnar conductor; and a wiring process of connecting electrically one line of a power feeding portion to the second main columnar conductor, and connecting electrically another line of the power feeding portion to the first main columnar conductor.

2. The method for installing the antenna device according to claim 1, wherein in the lower-side-columnar-conductor installing process, respective base-end portions of the first columnar sub-conductor, the second columnar sub-conductor, and the first main columnar conductor are fastened to a first lower dielectric spacer, a second lower dielectric spacer, and a lower center dielectric spacer mounted on the installation surface.

3. The method for installing the antenna device according to claim 2, wherein prior to the lower-side-columnar-conductor installing process, a lower-dielectric-spacer mounting process of mounting the first lower dielectric spacer, the second lower dielectric spacer, and the lower center dielectric spacer on the installation surface is performed.

4. The method for installing the antenna device according to claim 1, wherein prior to the lower-side-columnar-conductor installing process, the upper-side-columnar-conductor installing process is performed.

5. The method for installing the antenna device according to claim 1, wherein the lower-side-columnar-conductor electrical connecting process comprises:

a process of connecting electrically the first columnar sub-conductor with the first main columnar conductor by a first connection conductor, and a process of connecting electrically the second columnar sub-conductor with the first main columnar conductor by a second connection conductor.

6. The method for installing the antenna device according to claim 1, wherein in the U-shaped-conductor fastening process, the center portion of the U-shaped conductor is held and fastened between a first plate-like conductor formed at the tip portion of the second main columnar conductor and a second plate-like conductor disposed above the first plate-like conductor.

7. The method for installing the antenna device according to claim 6, wherein in the U-shaped-conductor fastening process, the second main columnar conductor that includes the first plate-like conductor or the second plate-like conductor is applied, and at least one of the first plate-like conductor and the second plate-like conductor has a groove into which the U-shaped conductor is fitted.

8. The method for installing the antenna device according to claim 1, wherein in the U-shaped-conductor fastening process, the U-shaped conductor being a columnar conductor having a smaller diameter than that of the second main columnar conductor is applied.

9. The method for installing the antenna device according to claim 1, wherein in the U-shaped-conductor fastening process, the U-shaped conductor that includes a first straight portion extending linearly from the one end to a first bent portion, a second straight portion extending linearly from the another end to a second bent portion, and the center portion extending linearly from the first bent portion to the second bent portion is applied.

10. An antenna device comprising:

a first columnar sub-conductor;

a second columnar sub-conductor arranged in parallel with the first columnar sub-conductor;

a main columnar conductor arranged between the first columnar sub-conductor and the second columnar sub-conductor, and comprising:

a first main columnar conductor connected electrically with the first columnar sub-conductor and the second columnar sub-conductor, and standing upright;

an upper center dielectric spacer mounted on a tip portion of the first main columnar conductor; and a second main columnar conductor with a base-end portion fastened to an opposite surface of the upper center dielectric spacer to a surface mounted on the tip portion of the first main columnar conductor, facing the first main columnar conductor, being disposed in series or linearly with the first main columnar conductor, and standing upright; a power feeding portion having one line connected electrically with the second main columnar conductor, and another line connected electrically with the first main columnar conductor; and a U-shaped conductor bent in a U-shape, and including one end that faces a tip portion of the first columnar sub-conductor, another end that faces a tip portion of the second columnar sub-conductor, and a center portion that is fastened to a tip portion of the second main columnar conductor;

wherein the first columnar sub-conductor, the second columnar sub-conductor and the first main columnar conductor constitute one dipole antenna exciter, and the second main columnar conductor and the U-shaped conductor constitute another dipole antenna exciter.

11. The antenna device according to claim 10, further comprising:

a first upper dielectric spacer formed at a tip portion of the first columnar sub-conductor; and a second upper dielectric spacer formed at a tip portion of the second columnar sub-conductor, wherein, the U-shaped conductor includes the one end fastened to the first upper dielectric spacer, and the other end fastened to the second upper dielectric spacer.

12. The antenna device according to claim 10, further comprising:

a first connection conductor connecting electrically the first columnar sub-conductor with the first main columnar conductor; and a second connection conductor connecting electrically the second columnar sub-conductor with the first main columnar conductor.

13. The antenna device according to claim 10, further comprising:

a lower center dielectric spacer mounted on an installation surface; and a first lower dielectric spacer and a second lower dielectric spacer both mounted on the installation surface so as to sandwich the lower center dielectric spacer, wherein, the lower center dielectric spacer is fastened to a base-end portion of the first main columnar conductor;

the first lower dielectric spacer is fastened to a base-end portion of the first columnar sub-conductor; and the second lower dielectric spacer is fastened to a base-end portion of the second columnar sub-conductor.

14. The antenna device according to claim 10, wherein:

the second main columnar conductor includes a first plate-like conductor formed at the tip portion of the main columnar conductor, and a second plate-like conductor disposed on the first plate-like conductor; and the center portion of the U-shaped conductor is held and fastened between the first plate-like conductor and the second plate-like conductor.

15. The antenna device according to claim 14, wherein at least either the first plate-like conductor or the second plate-like conductor is formed with a groove into which the U-shaped conductor is fitted.

16. The antenna device according to claim 10, wherein a diameter of the U-shaped conductor is smaller than that of the second main columnar conductor.

17. The antenna device according to claim 10, wherein the U-shaped conductor comprises:

a first straight portion extending linearly from the one end to a first bent portion;

a second straight portion extending linearly from the another end to a second bent portion; and the center portion extending linearly from the first bent portion to the second bent portion.

* * * * *